US009162842B2

(12) United States Patent
Komuro

(10) Patent No.: US 9,162,842 B2
(45) Date of Patent: Oct. 20, 2015

(54) MEDIUM RECEIVING CASSETTE AND RECORDING APPARATUS

(71) Applicant: SEIKO EPSON CORPORATION, Tokyo (JP)

(72) Inventor: Shintaro Komuro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/259,016

(22) Filed: Apr. 22, 2014

(65) Prior Publication Data

US 2014/0319761 A1 Oct. 30, 2014

(30) Foreign Application Priority Data

Apr. 24, 2013 (JP) ..... 2013-091043

(51) Int. Cl.

| | |
|---|---|
| ***B65H 1/00*** | (2006.01) |
| ***B65H 31/20*** | (2006.01) |
| ***B65H 31/22*** | (2006.01) |
| ***B65H 31/02*** | (2006.01) |
| ***B65H 1/02*** | (2006.01) |

(52) U.S. Cl.

CPC ..... *B65H 31/20* (2013.01); *B65H 1/027* (2013.01); *B65H 31/02* (2013.01); *B65H 31/22* (2013.01); *B65H 2301/4212* (2013.01); *B65H 2405/1124* (2013.01); *B65H 2405/11164* (2013.01); *B65H 2405/3322* (2013.01); *B65H 2701/1131* (2013.01); *B65H 2801/12* (2013.01)

(58) Field of Classification Search

CPC ..... B65H 2701/113; B65H 2701/1131; B65H 31/22; B65H 2405/11163; B65H 2405/11164

USPC ..... 271/171

See application file for complete search history.

(56) References Cited

U.S. PATENT DOCUMENTS

| | | | | |
|---|---|---|---|---|
| 6,053,493 | A * | 4/2000 | Yokoyama et al. | 271/171 |
| 6,474,884 | B2 * | 11/2002 | Chiu | 400/624 |
| 2006/0261535 | A1 | 11/2006 | Shiohara et al. | |
| 2007/0075477 | A1 | 4/2007 | Shiohara | |
| 2009/0302526 | A1 * | 12/2009 | Miyauchi | 271/163 |
| 2014/0246825 | A1 * | 9/2014 | Takemura et al. | 271/9.11 |

FOREIGN PATENT DOCUMENTS

| | | |
|---|---|---|
| JP | 2006-273565 | 10/2006 |
| JP | 2007-091445 | 4/2007 |

* cited by examiner

*Primary Examiner* — Howard Sanders
(74) *Attorney, Agent, or Firm* — Workman Nydegger

(57) ABSTRACT

Provided is a medium receiving cassette that includes a medium receiving portion in which a medium is received, a medium support tray which is pivotally provided on the medium receiving portion and of which a state can be switched, in a pivoting manner, between a received state in which the medium support tray is positioned above the medium receiving portion and a medium support surface for supporting the medium is directed downward and an expanded state in which the medium support surface is directed upward and at least a part of the medium support surface is expanded outside the medium receiving portion, and a drawer portion which is drawn out from the medium receiving portion to extend a length of the medium receiving portion in a medium discharging direction.

10 Claims, 24 Drawing Sheets

MEDIUM RECEIVING CASSETTE AND RECORDING APPARATUS

BACKGROUND

1. Technical Field

The present invention relates to a medium receiving cassette which is attachable/detachable to/from a main body of a recording apparatus which performs recording on a medium. Furthermore, the invention relates to a recording apparatus, such as a facsimile and a printer.

2. Related Art

In recent years, a paper sheet cassette which is attachable/detachable to/from an apparatus main body has been widely used for a recording apparatus, such as a facsimile and a printer. A paper sheet cassette which is attachable/detachable to/from an apparatus and which has a two-stage structure constituted by a lower paper sheet receiving portion and an upper paper sheet receiving portion has been known, for example, a structure disclosed in JP-A-2006-273565 or JP-A-2007-91445 of the related art.

The paper sheet cassette disclosed in JP-A-2006-273565 or JP-A-2007-91445 has a configuration in which a second paper feeding cassette on an upper-stage also functions as a discharged paper receiving portion for receiving a paper sheet on which recording is performed. In other words, the second paper feeding cassette is configured such that a user switches a position of the second paper feeding cassette between a retreated position to which the second paper feeding cassette retreats not to be obstructive when paper sheets are fed from a first paper feeding cassette located below the second paper feeding cassette and an advanced position to which the second paper feeding cassette is advanced to feed the paper sheets. Particularly, when the second paper feeding cassette is located at the retreated position, a relatively large paper sheet which is fed from the first paper feeding cassette and on which recording is performed can be received by the discharged paper receiving portion which is formed integrally with the second paper feeding cassette.

In a case where a discharged paper receiving portion is configured to be provided in a paper sheet cassette, as described above, it is not necessary to provide a supporting structure for supporting the discharged paper receiving portion, to a main body side of the recording apparatus. Thus, there is an advantage in that a reduction in costs can be achieved. However, there are also disadvantages as described below.

That is, it is preferable that a support surface of the discharged paper receiving portion, which supports the paper sheet, form an inclined surface of which a front edge is directed upward to prevent the discharged paper sheet from slipping off. However, in a case where the discharged paper receiving portion is configured to be provided in the paper sheet cassette, as in the related art described above, when the support surface for supporting the paper sheet is inclined upward, the entire height of the paper sheet cassette increases. As a result, a height of a recording apparatus main body to which the paper sheet cassette is mounted also increases.

SUMMARY

An advantage of some aspects of the invention is to provide a paper sheet cassette which has a support tray for supporting a discharged paper sheet while suppressing a height of the paper sheet cassette and which can easily expand a paper-sheet receiving area in accordance with a size of a paper sheet.

According to an aspect of the invention, there is provided a medium receiving cassette that includes a medium receiving portion in which a medium is received, a medium support tray which is pivotally provided on the medium receiving portion and of which a state can be switched, in a pivoting manner, between a received state in which the medium support tray is positioned above the medium receiving portion and a medium support surface for supporting the medium is directed downward and an expanded state in which the medium support surface is directed upward and at least a part of the medium support surface is expanded outside the medium receiving portion, and a drawer portion which constitutes an inner wall of the medium receiving portion on the medium discharging direction side, and which is drawn out from the medium receiving portion to extend a length of the medium receiving portion in a medium discharging direction.

In this case, the state of the medium support tray provided on the medium receiving cassette can be switched, in a pivoting manner, between the received state in which the medium support tray is positioned above the medium receiving portion and the medium support surface for supporting the medium is directed downward and the expanded state in which the medium support surface is directed upward and at least a part of the medium support surface is expanded outside the medium receiving portion. Thus, the medium support tray can take a different posture when the state of the medium support tray is switched between the received state and the expanded state. Therefore, a height (a size in a medium stacking direction) of the medium receiving cassette can be suppressed in the received state. Furthermore, appropriate posture of the medium support tray in the expanded state can be ensured.

Furthermore, when the drawer portion which constitutes an inner wall of the medium receiving portion on the medium discharging direction side is drawn out from the medium receiving portion, the length of the medium receiving portion is extended in the medium discharging direction. Therefore, it is possible to expand a medium receiving area in accordance with a size of the medium.

According to another aspect of the invention, there is provided a medium receiving cassette that includes a medium receiving portion in which a medium is received, a medium support tray which is provided on the medium receiving portion to be displaceable in a sliding manner and of which a state can be switched, in a sliding manner, between a received state in which the medium support tray is positioned above the medium receiving portion and an expanded state in which a medium support surface for supporting the medium is expanded outside the medium receiving portion, and a drawer portion which constitutes an inner wall of the medium receiving portion on the medium discharging direction side and which is drawn out from the medium receiving portion to extend a length of the medium receiving portion in a medium discharging direction.

In this case, the medium support tray which is provided on the medium receiving cassette can take a different posture in a sliding manner. Therefore, a height (a size in a medium stacking direction) of the medium receiving cassette can be suppressed in the received state. Furthermore, appropriate posture of the medium support tray in the expanded state can be ensured.

In addition, the state of the medium support tray can be switched between the received state and the expanded state by displacing the medium support tray in a sliding manner. Therefore, it is possible to switch the state of the medium support tray in a state where the medium receiving cassette is mounted to an apparatus main body of a recording apparatus, that is, without removing the medium receiving cassette from the apparatus main body.

A length of the medium receiving portion in a medium discharging direction can be extended by drawing out the drawer portion which constitutes an inner wall of the medium receiving portion on a medium discharging direction side. Thus, it is possible to expand a medium receiving area in accordance with a size of the medium.

In the medium receiving cassette, the drawer portion may constitute a wall of the medium receiving portion, which is located on a medium discharging direction side, and a length of the drawer portion in a medium width direction which is perpendicular to the medium discharging direction is shorter than a length of the medium receiving portion in the medium width direction.

In this case, the drawer portion constitutes a wall of the medium receiving portion, which is located on medium discharging direction side. In addition, the length of the drawer portion in the medium width direction, that is, a direction perpendicular to the medium discharging direction is shorter than the length of the medium receiving portion in the medium width direction. Accordingly, a space is formed on a lateral side of the drawer portion. Therefore, it is easy to place a user's finger on the drawer portion, and thus it is possible to easily draw out the drawer portion. In addition, it is possible to easily confirm, through the space, the presence or absence of the medium in medium receiving portion or a medium residual quantity in the medium receiving portion.

In the medium receiving cassette, the drawer portion may be disposed at a position shifted from a center of the medium receiving portion in the medium width direction.

In this case, the drawer portion is disposed at a position shifted from a center of the medium receiving portion in the medium width direction. Thus, the space can be formed in wide manner on the lateral side of the drawer portion. Accordingly, it is possible to more easily operate the drawer portion.

In the medium receiving cassette, when the medium support tray is in the expanded state, the medium support surface may form a surface inclined obliquely upward toward a front edge of the medium support tray.

In this case, the medium which is discharged from an upper side of the medium support tray and supported by the medium support surface can be prevented from slipping off the medium support tray because, when the medium support tray is in the expanded state, the medium support surface forms the surface inclined obliquely upward toward the front edge of the medium support tray. Therefore, the medium can be appropriately supported.

In the medium receiving cassette, when the medium support tray is in the expanded state, the medium support surface may form a surface inclined obliquely upward toward a front edge of the medium support tray.

In this case, the medium which is discharged from the upper side of the medium support tray and supported by the medium support surface can be prevented from slipping off the medium support tray because, when the medium support tray is in the expanded state, the medium support surface forms the surface inclined obliquely upward toward the front edge of the medium support tray. Therefore, the paper sheet can be appropriately supported.

In the medium receiving cassette, the medium support tray may include a tray main body portion which forms the medium support surface and arm portions which are provided on both end portions of the tray main body portion in the pivot-axis direction of the medium support tray, extend from the tray main body portion toward pivot centers of the medium support tray, are pivotally connected to the medium receiving portion, and form the pivot centers of the medium support tray.

In this case, the tray main body portion of the medium support tray is pivotally mounted to the medium receiving portion via the arm portions which form the pivot centers. In other words, when the medium support tray is in the expanded state, the tray main body portion can be located at the position spaced apart from the pivot centers. Accordingly, when the medium support tray is in the expanded state, an upper portion of the medium receiving portion can be opened in wide manner, and thus workability is improved when the medium receiving portion is filled with media.

In the medium receiving cassette, the medium support tray may include a tray main body portion which forms the medium support surface and arm portions which are provided on both end portions of the tray main body portion in the pivot-axis direction of the medium support tray, extend from the tray main body portion toward pivot centers of the medium support tray, are pivotally connected to a medium receiving portion, and form the pivot centers of the medium support tray.

In this case, the tray main body portion of the medium support tray is pivotally mounted to the medium receiving portion via the arm portions which form the pivot centers. In other words, when the medium support tray is in the expanded state, the tray main body portion can be located at the position spaced apart from the pivot centers. Accordingly, when the medium support tray is in the expanded state, an upper portion of the medium receiving portion can be opened in wide manner, and thus workability is improved when the medium receiving portion is filled with media.

According to still another aspect of the invention, there is provided a recording apparatus that includes a recording head which performs recording on a medium and the medium receiving cassette according to an aspect which is attachably/detachably mounted to an apparatus main body having the recording head. The medium which is discharged from the apparatus main body and on which recording is performed is supported by the medium support tray in the expanded state.

In this case, the recording apparatus which performs recording on the medium can achieve the same operational effects as those in the aspects.

According to still another aspect of the invention, there is provided a recording apparatus that includes a recording head which performs recording on a medium and the medium receiving cassette according to the aspects which is attachably/detachably mounted to an apparatus main body having the recording head. The medium which is discharged from the apparatus main body and on which recording is performed is supported by the medium support tray in the expanded state.

In this case, the recording apparatus which performs recording on the medium can achieve the same operational effects as those in the aspects.

In the recording apparatus, when the medium receiving portion is mounted, the medium receiving portion may protrude from one side surface of the apparatus main body, which constitutes the periphery of the apparatus main body. In addition, an opening portion may be formed between the part of the medium receiving portion, which protrudes from the one side surface, and the medium support tray.

In this case, the opening portion is formed between the medium receiving portion and the medium support tray, and thus presence or absence of media in the medium receiving portion can be easily confirmed through the opening portion.

The recording apparatus may further include a discharging roller for discharging the medium and an intermediate guiding member which is provided between the discharging roller and the medium support tray and which forms a guiding surface for guiding the medium to the medium support tray.

In this case, the intermediate guiding member which is provided between the discharging roller for discharging the medium and the medium support tray and which forms the guiding surface for guiding the medium to the medium support tray is further provided, and thus the discharged medium is smoothly supported by the medium support tray.

In the recording apparatus, the intermediate guiding member may also function as a cover which covers the opening portion.

In this case, the intermediate guiding member also functions as the cover which covers the opening portion, and thus foreign matter can be prevented from entering into the opening portion. In addition, the intermediate guiding member also functions as the cover, and thus it is possible to suppress an increase in costs.

In the recording apparatus, the intermediate guiding member may be pivotally mounted, and a posture of the intermediate guiding member may be changed in accordance with a posture of the medium support tray.

In this case, the intermediate guiding member is pivotally mounted and of which the posture can be changed in accordance with the posture of the medium support tray. Therefore, it is possible to more smoothly guide the discharged medium to the medium support tray.

In the recording apparatus, when the medium receiving cassette is mounted, the medium receiving cassette may protrude from one side surface of the apparatus main body, which constitutes the periphery of the apparatus main body. In addition, an intermediate guiding member which covers an upper portion of the part of the medium receiving cassette, which protrudes from the one side surface, and which guides a discharged medium to the medium support tray when the medium support tray is in the expanded state may be provided.

In this case, the medium can be smoothly discharged from the recording apparatus main body to the medium support tray, through the intermediate guiding member.

In the recording apparatus, an opening through which a part of the medium support tray in the received state is exposed may be formed on the intermediate guiding member.

In this case, the opening through which the part of the medium support tray in the received state is exposed is formed on the intermediate guiding member, and thus favorable gripping performance is ensured when the medium support tray is drawn out. As a result, it is possible to easily draw out the medium support tray.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Hereinafter, Embodiment 1 of the invention will be described with reference to the accompanying drawings.

Figure 1:
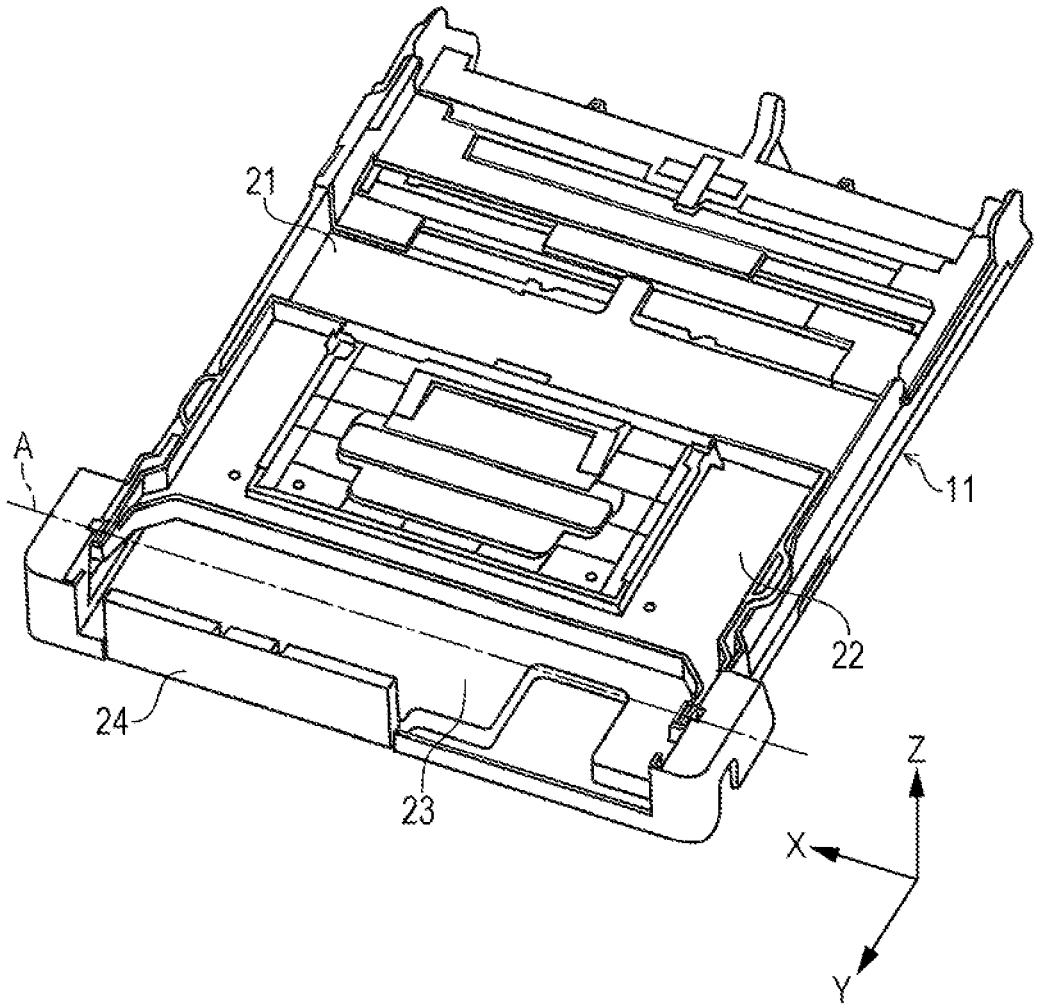
FIG. 1 is a perspective view illustrating an external appearance of a paper feeding cassette according to the invention.
Figure 2:
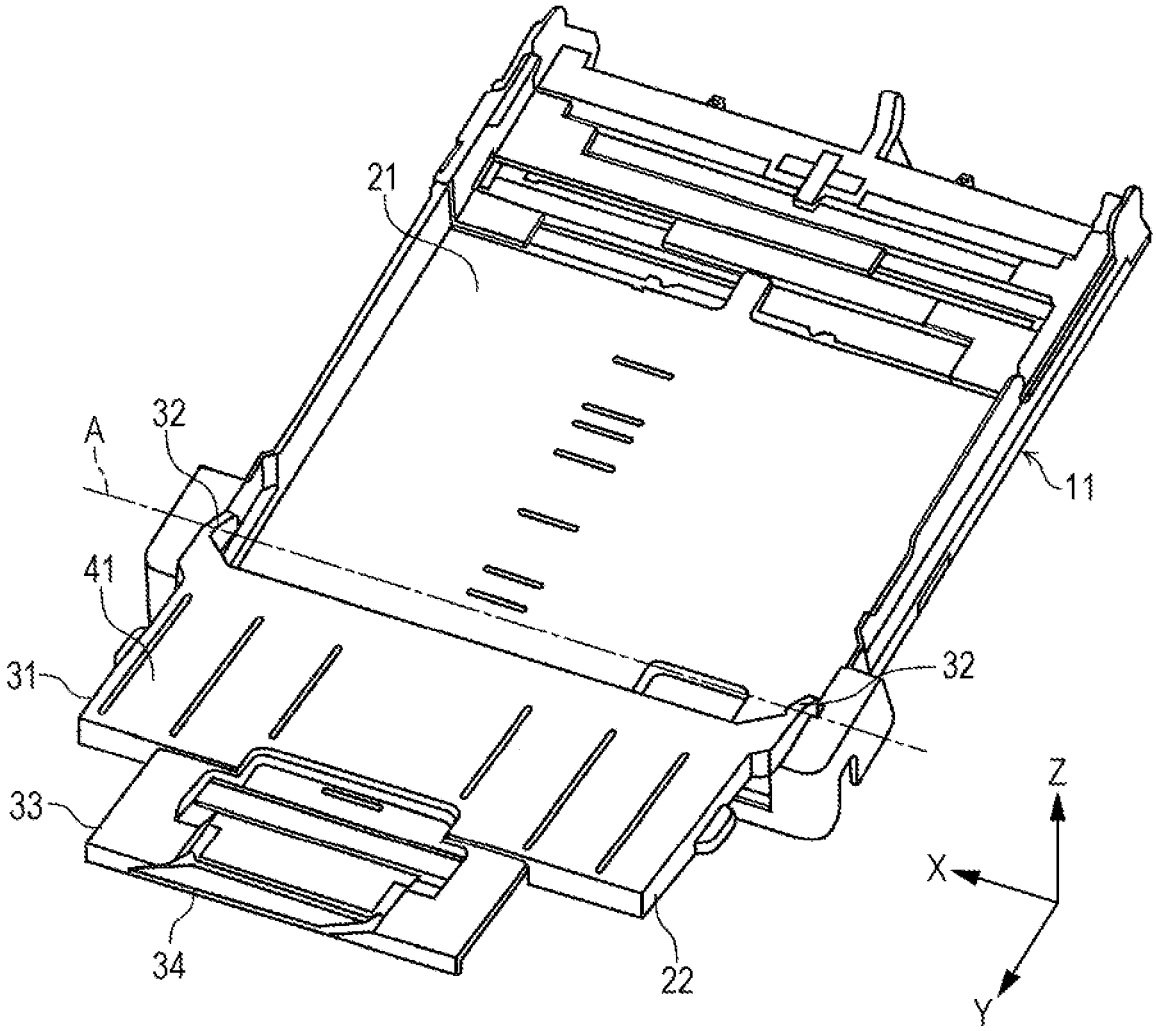
FIG. 2 is a perspective view illustrating an external appearance of the paper feeding cassette according to the invention.

FIGS. 1 and 2 are perspective views illustrating an external appearance of a paper feeding cassette 11 according to the Embodiment 1 of the invention. FIG. 1 is a perspective view illustrating the external appearance of the paper feeding cassette 11 in a received state. The received state is a state in which a stacker 22 is received in the paper feeding cassette 11. FIG. 2 is a perspective view illustrating the external appearance of the paper feeding cassette 11 in an expanded state. The expanded state is a state in which the stacker 22 is expanded.

In the following description, a front-rear direction of the paper feeding cassette 11 is set to a Y axis, an up-down direction thereof is set to a Z axis, and a right-left direction is set to an X axis. Further, in the following description, a left side in FIG. 1, in terms of the X-axis direction, is simply referred to as a left side and a right side in FIG. 1, in terms of an X-axis direction, is simply referred to as a right side. In addition, in the following description, a front side in FIG. 1, in terms of a Y-axis direction, is simply referred to as a front side and a back side in FIG. 1, in terms of the Y-axis direction, is simply referred to as a rear side. In addition, in the following description, an upper side in FIG. 1, in terms of a Z-axis direction, is simply referred to as an upper side and a lower side in FIG. 1, in terms of the Z-axis direction, is simply referred to as a lower side.

The paper feeding cassette 11 is an example of a medium receiving cassette which is attachably/detachably mounted to a main body of a recording apparatus that performs recording on a medium. Paper sheets as an example of media are received in the paper feeding cassette 11.

The paper feeding cassette 11 includes a receiving portion 21, the stacker 22, and a drawer portion 24. In a front side of the paper feeding cassette 11, an opening portion 23 is formed between the receiving portion 21 and the stacker 22. The receiving portion 21 is an example of a medium receiving portion and receives paper sheets which are stacked up in the Z-axis direction. The paper feeding cassette 11 is mounted to a printer 51 (see FIG. 4, described below) as an example of a recording apparatus. When the printer 51 performs printing on the paper sheets, the printer 51 causes the received paper sheet to be fed from the receiving portion 21 and to be transferred. Then the printer 51 performs recording on the paper sheet.

The stacker 22 is an example of a medium support tray. In a case where the paper feeding cassette 11 is mounted on the printer 51 and the printer 51 performs recording on the paper sheet, the stacker 22 supports the recorded and discharged paper sheet. A tray main body portion 31, arm portions 32, a drawer tray 33, and an expansion tray 34 are provided in the stacker 22. The tray main body portion 31 is an example of a tray main body portion and pivotally mounted to the receiving portion 21. A support surface 41 as an example of a medium support surface is formed on one surface of the tray main body portion 31.

A state of the stacker 22 can be switched between a received state (see FIG. 1) and an expanded state (see FIG. 2). When the stacker 22 is in the received state, the stacker 22 is positioned above the receiving portion 21. Furthermore, when the stacker 22 is in the received state, the support surface 41 which supports the paper sheet is directed downward. When the stacker 22 is in the expanded state, the support surface 41 is directed upward and expanded outside the receiving portion 21.

The state of the stacker 22 can be switched between the received state and the expanded state, and thus the stacker 22 can take a different posture (that is, the support surface 41 can be positioned at different angles) when the state of the stacker 22 is switched between the received state and the expanded state. Therefore, the support surface 41 in the received state becomes parallel to a bottom surface of the receiving portion 21, and thus a height (a size in a medium stacking direction) of the paper feeding cassette 11 can be suppressed in the received state. Furthermore, appropriate posture (in which the support surface 41 is inclined upward) of the stacker 22 in the expanded state can be ensured.

In other words, when the stacker 22 is in the expanded state, a Z-axis position of the support surface 41 gradually changes to be directed upward as a Y-axis position of the support surface 41 changes forward. That is, when the stacker 22 is in the expanded state, the support surface 41 forms a surface inclined obliquely upward toward a front edge of the stacker 22. Accordingly, the paper sheet which is discharged from an upper side of the stacker 22 and supported by the support surface 41 can be prevented from slipping off the stacker 22. Therefore, the paper sheet can be appropriately supported.

When the state of the stacker 22 is switched from the received state to the expanded state or switched from the expanded state to the received state, the stacker 22 is pivoted on the arm portions 32 by a user. The user is not limited to an end user but includes all people operating the paper feeding cassette 11, such as a person who assembles the recording apparatus including the paper feeding cassette 11 and a person who performs customer service.

The arm portion 32 is an example of an arm portion and is pivotally connected to the receiving portion 21 to form a pivot center of the stacker 22. For example, protrusions having cylindrical-shapes are formed on a left side of the left arm portion 32 and on a right side of the right arm portion 32, and concave portions having a shape corresponding to the protrusions of the arm portions 32 are formed on the receiving portion 21. The protrusions are respectively inserted in to the concave portions, and thus the arm portions 32 can pivot with respect to the receiving portion 21.

Figure 3:
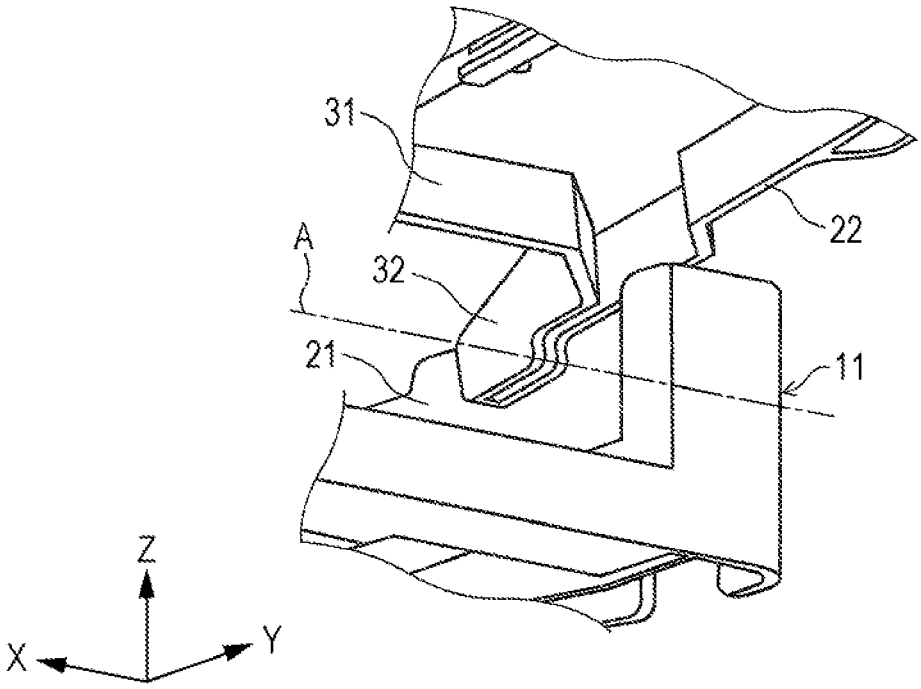
FIG. 3 is an enlarged view illustrating a right side arm portion.

FIG. 3 is an enlarged view illustrating the right side arm portion 32. Line A illustrated in FIGS. 1 to 3 shows a pivot axis line which is a pivot center axis of the stacker 22. The arm portions 32 are provided on both end portions of the tray main body portion 31 in the pivot-axis direction of the stacker 22. Each arm portion 32 is formed to extend from the tray main body portion 31 to the pivot center of the stacker 22.

As described above, the tray main body portion 31 of the stacker 22 is pivotally mounted to the receiving portion 21 via the arm portions 32 which form the pivot centers. That is, when the stacker 22 is in the expanded state, the tray main body portion 31 can be located at a position spaced apart from the pivot center. In other words, when the stacker 22 is in the expanded state, the tray main body portion 31 can be located at a position spaced apart from the receiving portion 21. Thus, when the stacker 22 is in the expanded state, an upper portion of the receiving portion 21 can be opened in wide manner. As a result, workability is improved when the receiving portion 21 is filled with paper sheets.

The drawer tray 33 can be received in the tray main body portion 31 or can be drawn out from the tray main body portion 31. When the drawer tray 33 is received in the tray main body portion 31, a front edge of the drawer tray 33 is aligned with a front edge (a front edge of an end portion opposite an end portion in which the arm portion 32 is provided) of the tray main body portion 31. In addition, when the stacker 22 is in the expanded state and the drawer tray 33 is drawn out from the tray main body portion 31, the drawer tray 33 expands the support surface 41 to a front edge side of the tray main body portion 31.

The expansion tray 34 is pivotally mounted to the front edge of the drawer tray 33. The expansion tray 34 can be received in the drawer tray 33 or can be expanded from the drawer tray 33. When the expansion tray 34 is received in the drawer tray 33, the expansion tray 34 is accommodated in a concave portion which is formed in the drawer tray 33 and of which the shape corresponds to the expansion tray 34.

Accordingly, the expansion tray 34 does not obstruct receiving of the drawer tray 33 in the tray main body portion 31 or drawing-out of the drawer tray 33 from the tray main body portion 31.

In a state where the stacker 22 is expanded and the drawer tray 33 is drawn out from the tray main body portion 31, when the expansion tray 34 is expanded from the drawer tray 33, the expansion tray 34 forms a surface which is inclined further upward from the front edge of the drawer tray 33 which forms an surface inclined obliquely upward. In other words, the expansion tray 34 forms a surface inclined obliquely upward at angles greater than the angles of an inclined surface of the drawer tray 33, with respect to the drawer tray 33 which forms a surface inclined obliquely upward at the predetermined angles, relative to a horizontal plane formed by the X axis and the Y axis. As a result, the paper sheet which is discharged from the upper side of the stacker 22 and supported by the support surface 41 is prevented from slipping off from the front edge of the tray main body portion 31. Therefore, the paper sheet can be supported appropriately.

The drawer portion 24 constitutes a front-side (a paper-sheet discharging direction side: +Y side) wall surface of the receiving portion 21. The drawer portion 24 is provided on a front side of the paper feeding cassette 11 and can be drawn forward from the receiving portion 21. When a paper sheet having a length longer than a length (a length in the Y-axis direction) of the paper feeding cassette 11 is received in the paper feeding cassette 11, the drawer portion 24 is drawn forward from the receiving portion 21. In the front side of the paper feeding cassette 11, the opening portion 23 is formed between the receiving portion 21 and the stacker 22. Thus, presence or absence of the paper sheet in the paper feeding cassette 11 can be easily confirmed through the opening portion 23.

In addition, a length (a length in the X direction) of the drawer portion 24 in a paper sheet width direction is shorter than a length of the receiving portion 21 in the paper sheet width direction. Thus, a space 25 (see FIG. 4) through which a user's finger can be inserted into is formed on a lateral side of the drawer portion 24. Therefore, it is possible to place the user's finger on the drawer portion 24 regardless of the state of the stacker 22, and thus it is possible to easily slide the drawer portion 24. In addition, even in a case where the paper feeding cassette 11 is mounted to the printer main body, it is possible to easily confirm presence or absence of the paper sheet in the paper feeding cassette or a paper residual quantity in the paper feeding cassette, through the space 25 which is formed on the lateral side of the drawer portion 24.

Furthermore, the drawer portion 24 is disposed (on a left side in the drawing, in this embodiment) at a position shifted from a center of the receiving portion 21 in a paper-sheet width direction. Thus, the space 25 can be formed in wide manner on the lateral side of the drawer portion 24. Accordingly, it is possible to more easily operate the drawer portion 24.

Furthermore, the drawer portion 24 is provided to allow a paper sheet having a larger size to be received in the receiving portion 21, and thus an inner wall of the receiving portion 21 may not be provided. For example, any configuration can be applied as long as it can function as an edge guide for supporting a trailing edge of the paper sheet.

Figure 4:
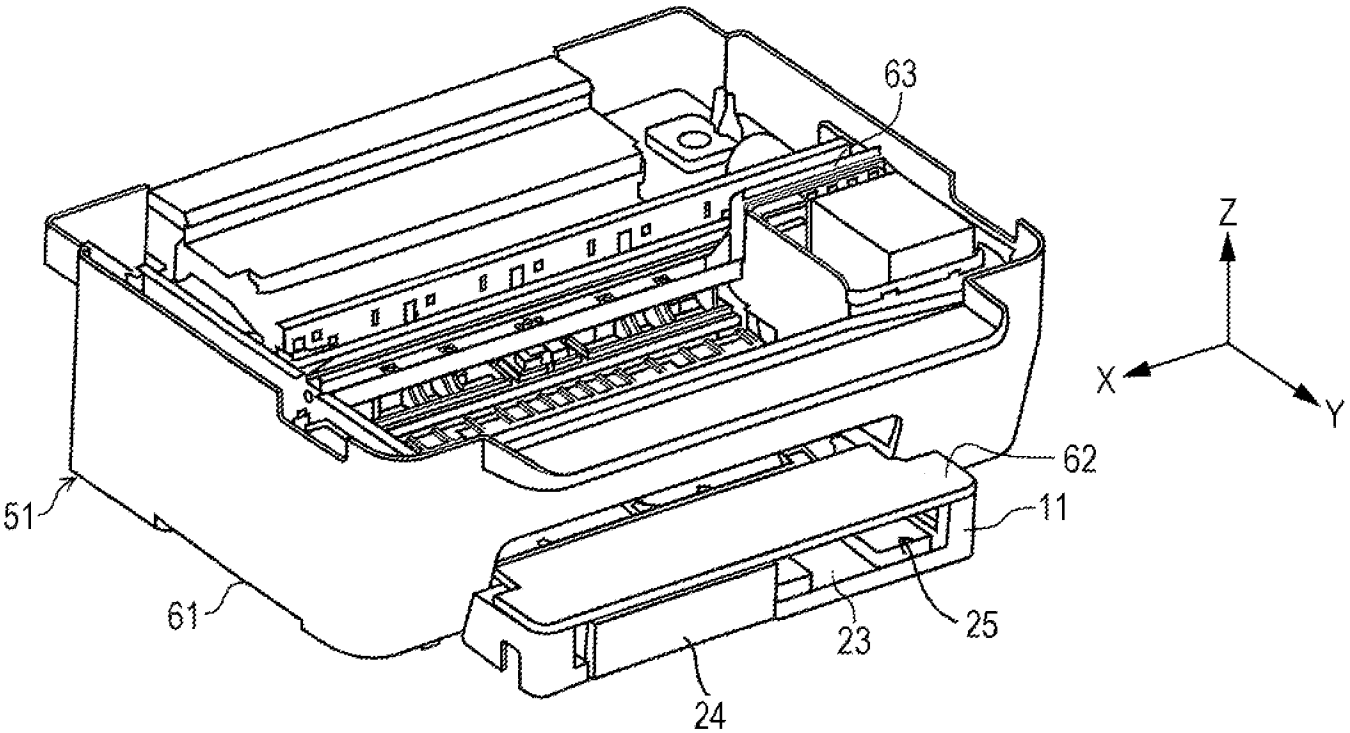
FIG. 4 is a perspective view illustrating a cross-sectional surface and an external appearance of an upper side of a printer according to the invention.
Figure 5:
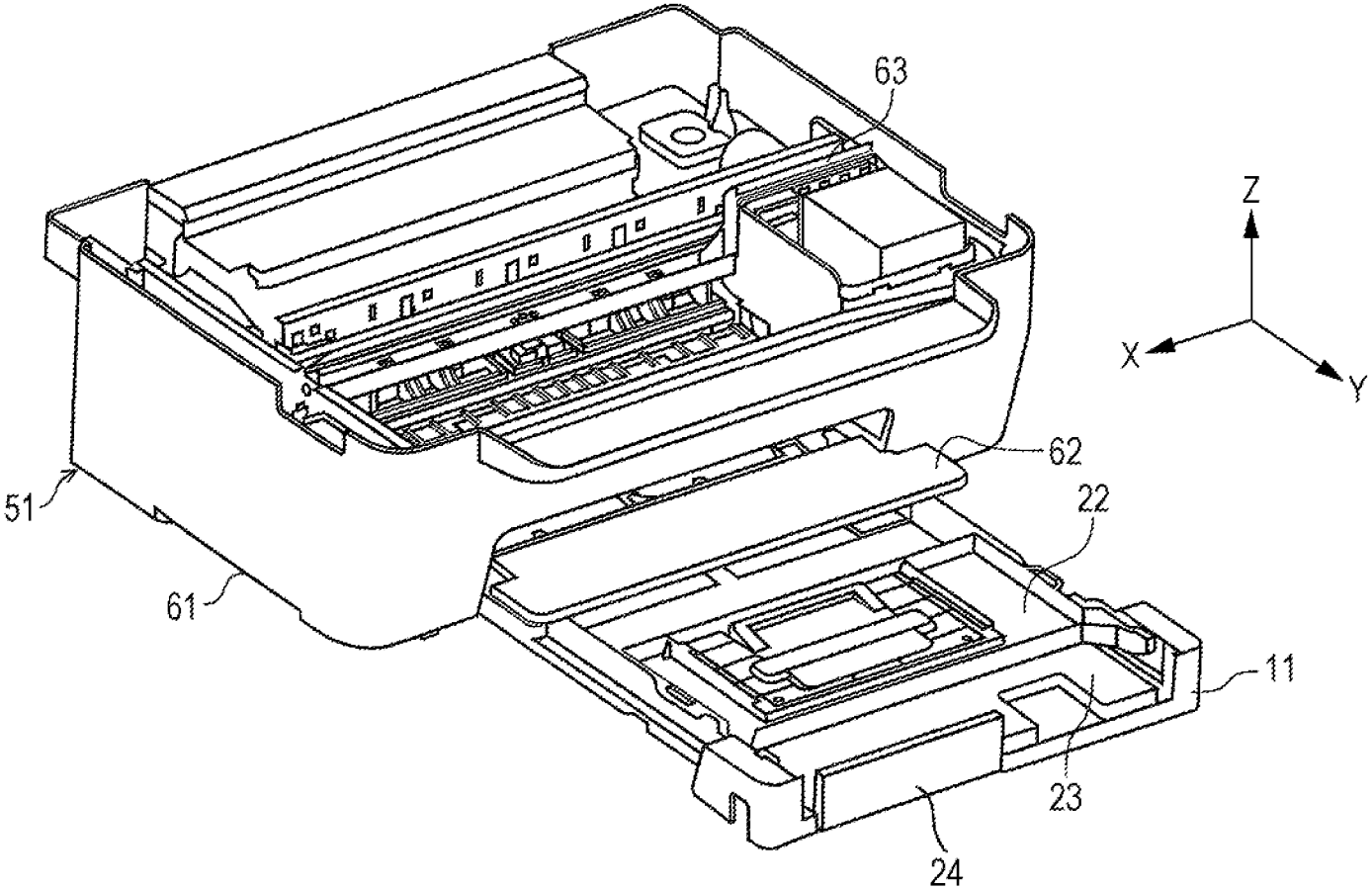
FIG. 5 is a perspective view illustrating a cross-sectional surface and an external appearance of the upper side of the printer according to the invention.
Figure 6:
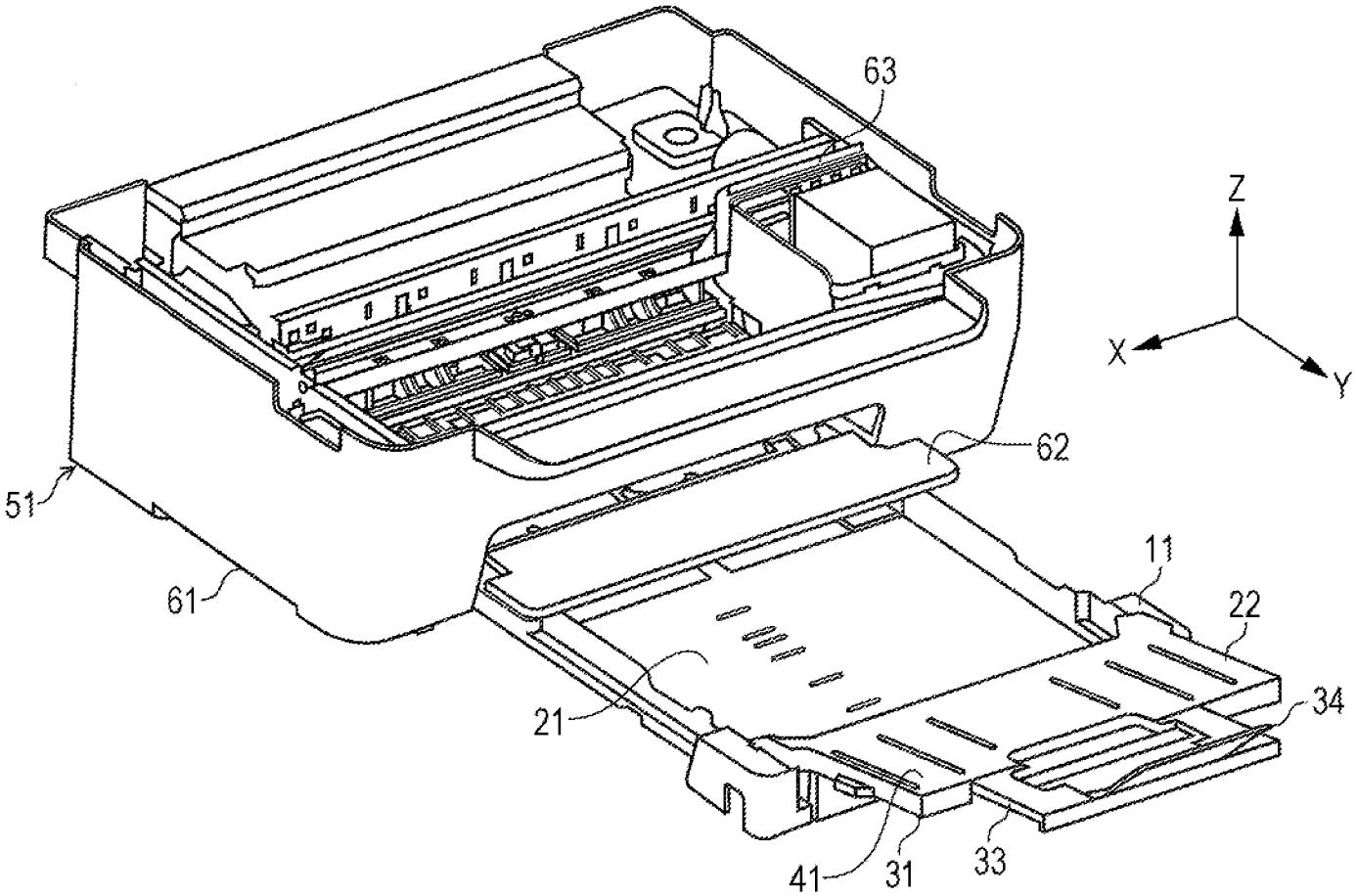
FIG. 6 is a perspective view illustrating a cross-sectional surface and an external appearance of the upper side of the printer according to the invention.
Figure 7:
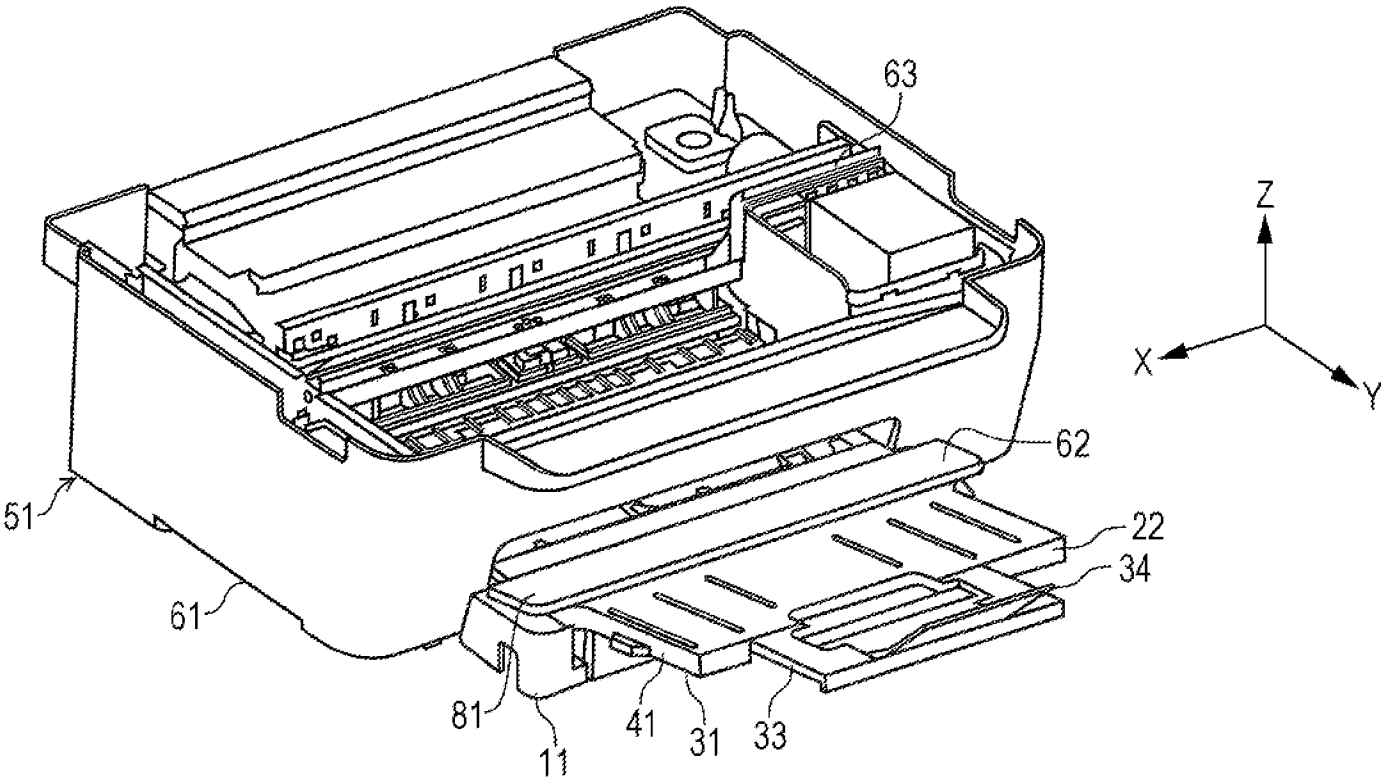
FIG. 7 is a perspective view illustrating a cross-sectional surface and an external appearance of the upper side of the printer according to the invention.

FIGS. 4 to 7 are perspective views illustrating cross-sectional surfaces and external appearances of the upper side of the printer 51 which has the paper feeding cassette 11. FIG. 4 is the perspective view illustrating the cross-sectional surface and the external appearance of the upper side of the printer 51 in which the paper feeding cassette 11 in the received state is mounted. FIG. 5 is the perspective view illustrating the cross-sectional surface and the external appearance of the upper side of the printer 51 in which the paper feeding cassette 11 in the received state is drawn out. FIG. 6 is the perspective view illustrating the cross-sectional surface and the external appearance of the upper side of the printer 51 in which the drawn paper feeding cassette 11 is in the expanded state. FIG. 7 is the perspective view illustrating the cross-sectional surface and the external appearance of the upper side of the printer 51 in which the paper feeding cassette 11 in the expanded state is mounted.

The printer 51 is an example of a recording apparatus and records text, images or the like on the paper sheet which is received in the paper feeding cassette 11. The paper feeding cassette 11, a main body 61, a cover 62, and a carriage 63 are provided in the printer 51. A transport portion (not illustrated) which is used for transporting the paper sheet, an operation panel (not illustrated) which is operated by a user, a controller (not illustrated), which controls the entirety of the printer 51, and the like are provided in the main body 61 of the printer 51, in addition to the cover 62 and the carriage 63. The main body 61 is an example of an apparatus main body. The cover 62 is an example of an intermediate guiding member and a cover. The cover 62 is pivotally mounted to an opening portion which is the opening portion of the main body 61 and to which the paper feeding cassette 11 is mounted. When the paper feeding cassette 11 is mounted to the main body 61, the cover 62 covers the opening portion 23 of the paper feeding cassette 11.

The carriage 63 includes a recording head (described below) which prints text or images on the paper sheet using ink or the like. When recording is performed, the carriage 63 moves in the X-axis direction by receiving power from, for example, a motor (not shown).

When not using the printer 51, for example, the state of the paper feeding cassette 11 is switched to the received state, and then the paper feeding cassette 11 in the received state is mounted to the printer 51, as illustrated in FIG. 4. When using the printer 51 or filling the paper feeding cassette 11 with the paper sheets, first, the paper feeding cassette 11 in the received state is drawn out from the printer 51, as illustrated in FIG. 5. Then, the state of the drawn paper feeding cassette 11 is switched to the expanded state, as illustrated in FIG. 6.

In other words, the stacker 22 of the paper feeding cassette 11 which is drawn out from the printer 51 is pivoted on the arm portions 32 by a user, and thus the stacker 22 is expanded outside the receiving portion 21 in a state where the support surface 41 is directed upward. Next, the drawer tray 33 is drawn out from the tray main body portion 31 by a user. Subsequently, the expansion tray 34 is pivoted by a user, and thus is expanded from the drawer tray 33. In this case, the tray main body portion 31 is located, by the arm portions 32, at a position spaced apart from the pivot centers. Accordingly, the upper side of the receiving portion 21 is opened in wide manner, and thus the paper sheets can be easily received in the receiving portion 21, as illustrated in FIG. 6.

In a case where the paper sheets are received in the paper feeding cassette 11 and the printer 51 is not used, the state of the paper feeding cassette 11 is returned to the received state and the paper feeding cassette 11 in the received state is mounted to the printer 51, as illustrated in FIG. 4.

When using the printer 51, the paper feeding cassette 11 in the expanded state is mounted to the printer 51, as illustrated in FIG. 7. When the paper feeding cassette 11 is in a mounted state, the paper feeding cassette 11 protrudes from one side surface of the main body 61, which constitutes a periphery of the main body 61. In a part of the paper feeding cassette 11, which protrudes from the one side surface, the opening portion 23 is formed between the receiving portion 21 and stacker 22. The cover 62 which is provided on the main body 61 covers the opening portion 23.

The opening portion 23 is formed between the receiving portion 21 and the stacker 22, and the cover 62 which covers the opening portion 23 is provided on the main body 61. Thus, presence or absence of media in the paper feeding cassette 11 can be easily confirmed through the opening portion 23. Furthermore, the cover 62 is provided on the opening portion 23, and thus foreign matter can be prevented from entering into the opening portion 23.

The recorded paper sheet which is discharged from the main body 61 is supported by the stacker 22 in the expanded state.

Furthermore, when the paper feeding cassette 11 in the expanded state is mounted to the printer 51, a front edge (a front side end portion in the Y-axis direction) of the cover 62 is supported by the support surface 41 of the tray main body portion 31 so as to be lifted upward. Thus, the upper surface 81 of the cover 62 forms a surface inclined obliquely upward toward the front edge side. In other words, when the stacker 22 is in the expanded state, the upper surface 81 of the cover 62 forms a guiding surface for guiding the discharged paper sheet to the stacker 22.

Figure 8:
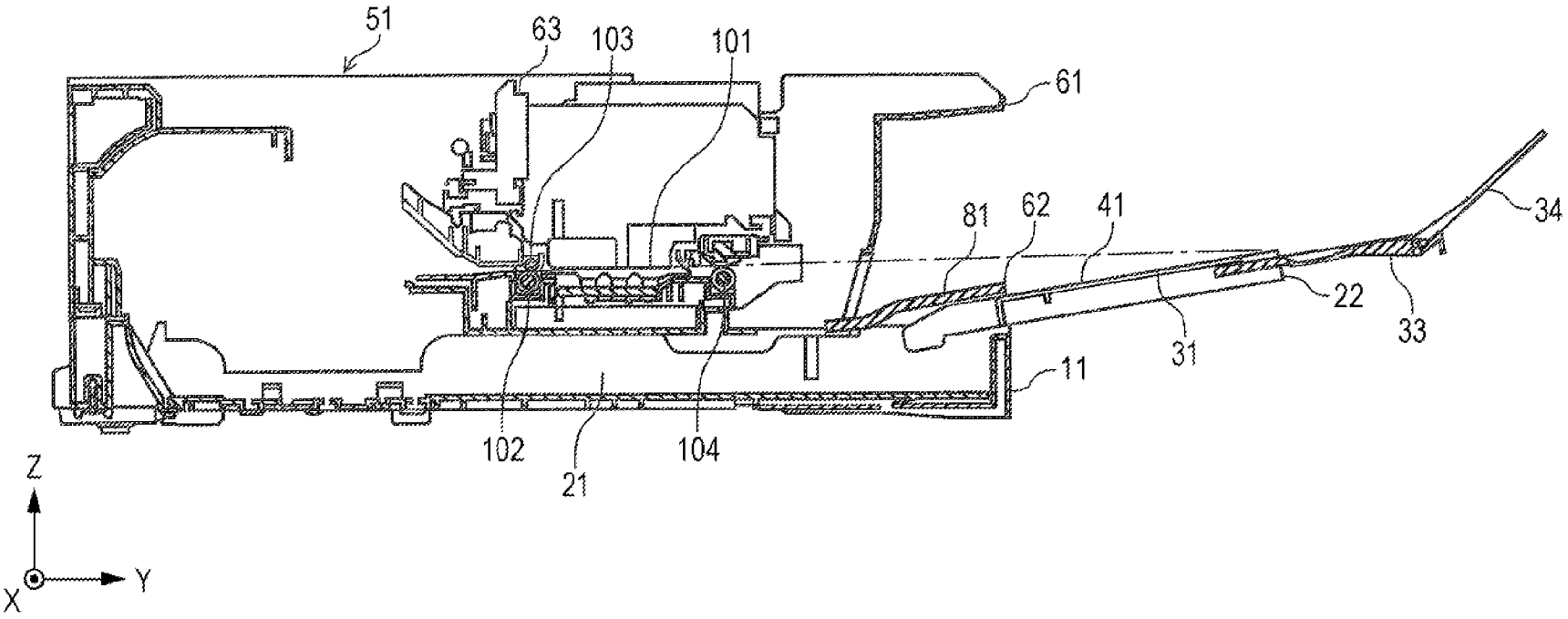
FIG. 8 is a cross-sectional view of a printer according to the invention.

FIG. 8 is a cross-sectional view of the printer 51 in a state where the paper feeding cassette 11 in the expanded state is mounted to the printer 51, taken along a plane formed by the Z axis and Y axis. A recording head 101 is an example of a recording unit and performs recording on the paper sheet. More specifically, the recording head 101 is provided on a bottom surface side of the carriage 63, that is, a side of the paper sheet which is transported by the transporting portion. The recording head 101 prints text or images on the paper sheet using ink or the like. When the paper sheet is transported forward (a right side in FIG. 8) through a sending path, a roller 102 is rotated in a clockwise direction in FIG. 8 by a driving portion (not shown). A roller 103 is disposed to be in contact with the roller 102. When the paper sheet is transported forward through the sending path, the roller 103 is rotated in a counterclockwise direction in FIG. 8 by the roller 102. The roller 102 and the roller 103 pinch the paper sheet and send the paper sheet to the recording head 101 and a roller 104.

When the paper sheet which is subjected to recording by the recording head 101 is transported forward (a right side in FIG. 8), the roller 104 is rotated in the clockwise direction in FIG. 8 by a driving portion (not shown). The roller 104 is disposed to be in contact with a roller (not shown) which faces the roller 104 with the paper sheet pinched by the rollers. The roller 104 and the facing roller pinch the recorded paper sheet and send the paper sheet to the stacker 22 in the expanded state. The stacker 22 in the expanded state supports the transported paper sheet.

A straight line which connects a point at which the paper sheet is pinched by the roller 102 and the roller 103 and a point at which the paper sheet is pinched by the roller 104 and the facing roller intersects with the support surface 41 of the tray main body portion 31 of the stacker 22. Therefore, in a case where recording is performed on a thick paper sheet, when a trailing edge of the paper sheet passes through a portion between the roller 102 and the roller 103, the paper sheet is supported by the roller 104, the facing roller, and the support surface 41 of the tray main body portion 31 of the stacker 22, and thus a distance between the paper sheet and the recording head 101 is maintained. Accordingly, the paper sheet is not in contact with the recording head 101, and thus it is possible to perform recording without deteriorating the recording quality.

Furthermore, when the paper feeding cassette 11 in the expanded state is mounted to the printer 51, the front edge portion of the cover 62 is lifted by the support surface 41. Therefore, the cover 62 forms the guiding surface for guiding the discharged paper sheet to the stacker 22. More specifically, the front edge portion of the cover 62 is lifted by the support surface 41, and thus inclination angles of the upper surface 81 of the cover 62 are set to be the substantially same as inclination angles of the support surface 41 which is inclined obliquely upward. Therefore, the upper surface 81 of the cover 62 and the support surface 41 form a single surface. In other words, when the stacker 22 is in the expanded state, the cover 62 causes the support surface 41 of the stacker 22 to expand to the main body 61 side. When the stacker 22 is in the expanded state, the cover 62 forms the guiding surface for guiding the discharged paper sheet to the stacker 22. Thus, the discharged paper sheet is smoothly supported by the stacker 22.

The cover 62 is pivotally mounted, as described above, and thus the posture of the cover 62 can be changed in accordance with the posture of the stacker 22. The cover 62 is pivotally mounted and the posture of the cover 62 can be changed in accordance with the posture of the stacker 22, and thus it is possible to more smoothly guide the discharged paper sheet to the stacker 22.

Figure 9:
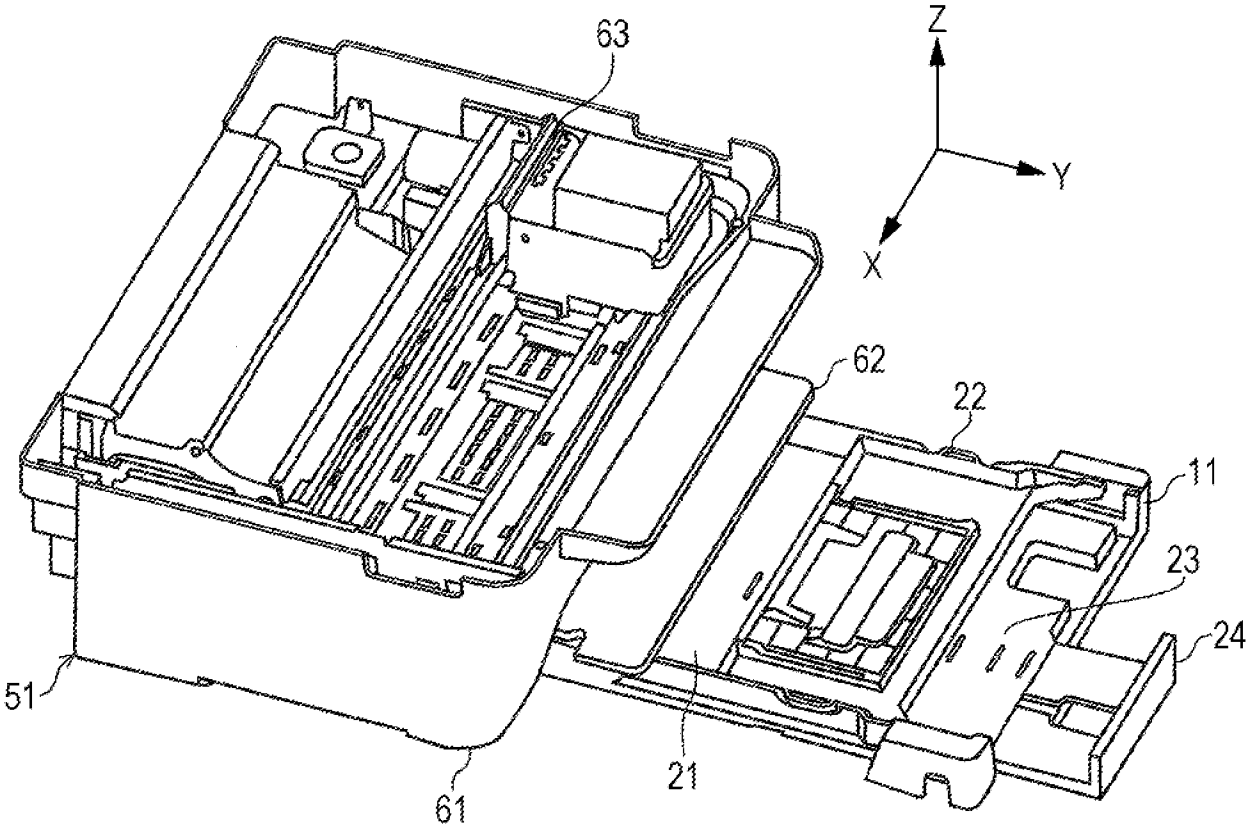
FIG. 9 is a perspective view illustrating a cross-sectional surface and an external appearance of the upper side of the printer according to the invention.

FIG. 9 is a perspective view illustrating a cross-sectional surface and an external appearance of the upper side of the printer 51 in a state where the paper feeding cassette 11 in the received state is drawn out and the drawer portion 24 is drawn forward from the receiving portion 21. When the drawer portion 24 is drawn forward from the receiving portion 21, the opening portion 23 between the receiving portion 21 and the stacker 22 are widened in the Y-axis direction. Thus, it is possible to easily fill the receiving portion 21 with the paper sheets through the opening portion 23. In addition, it is possible to fill the paper feeding cassette 11 with paper sheets having a length longer than a length (a length in the Y-axis direction) of the paper feeding cassette 11.

In addition, it is possible to slide the drawer portion 24 separately from the stacker 22. Thus, when the drawer portion 24 is operated, it is not necessary to operate the stacker 22, and thus operability is improved. In addition, the paper sheets can be set by extending the drawer portion 24, without drawing out the entirety of the paper feeding cassette 11. For this reason, favorable operability is ensured, as well.

The printer 51 is applied as an example of a recording apparatus. However, without being limited thereto, a recording apparatus, such as a printing apparatus, a copying machine, a facsimile machine, and other devices may be applied.

As described above, the receiving portion 21 in which the paper sheets are received and the stacker 22 can be provided in the paper feeding cassette 11. In this case, the stacker 22 is pivotally provided on the receiving portion 21 and the state of the stacker 22 can be switched, in a pivoting manner, between the received state in which the stacker 22 is positioned above the receiving portion 21 and the support surface 41 supporting the paper sheet is directed downward and the expanded state in which the support surface 41 is directed upward and at least a part of the support surface 41 is expanded outside the receiving portion 21.

The stacker 22 can take a different posture when the state of the stacker 22 is switched between the received state and the expanded state, because the state of the stacker 22 which is provided on the paper feeding cassette 11 can be switched, in a pivoting manner, between the received state in which the stacker 22 is positioned above the receiving portion 21 and the support surface 41 supporting the paper sheet is directed downward and the expanded state in which the support surface 41 is directed upward and the support surface 41 is expanded outside the receiving portion 21. Therefore, the height (the size in a paper-sheet stacking direction) of the paper feeding cassette 11 can be suppressed in the received state. Furthermore, appropriate posture of the stacker 22 in the expanded state can be ensured.

The length of the receiving portion 21 in the paper-sheet discharging direction (the Y direction) can be extended by drawing the drawer portion 24. Thus, it is possible to expand a paper-sheet receiving area in accordance with the size of the paper sheet.

The drawer portion 24 constitutes a wall of the receiving portion 21, which is located on the paper-sheet discharging direction side. In addition, the length of the drawer portion 24 in the paper-sheet width direction (the X direction) which perpendicular to the paper-sheet discharging direction is shorter than the length of the receiving portion 21 in the paper-sheet width direction. Accordingly, the space 25 is formed on the lateral side of the drawer portion 24. Therefore, it is easy to place user's finger on the drawer portion 24, and thus it is possible to easily draw out the drawer portion 24. In addition, it is possible to easily confirm, through the space 25, presence or absence of the paper sheet in the receiving portion 21 or a paper residual quantity in the receiving portion 21.

The drawer portion 24 is disposed at a position shifted from the center of the receiving portion 21 in the paper-sheet width direction. Thus, the space 25 can be formed in wide manner on the lateral side of the drawer portion 24. Accordingly, it is possible to more easily operate the drawer portion 24.

When the stacker 22 is in the expanded state, the support surface 41 can form the surface inclined obliquely upward toward the front edge of the stacker 22. The paper sheet which is discharged from the upper side of the stacker 22 and supported by the support surface 41 can be prevented from slipping off the stacker 22, because, when the stacker 22 is in the expanded state, the support surface 41 forms the surface inclined obliquely upward toward the front edge of the stacker 22. As a result, the paper sheet can be appropriately supported.

The tray main body portion 31 which forms the support surface 41 and the arm portions 32 can be provided in the stacker 22. The arm portions 32 are provided on both end portions of the tray main body portion 31 in the pivot-axis direction of the stacker 22 and extend from the tray main body portion 31 toward the pivot centers of the stacker 22. Furthermore, the arm portions 32 are pivotally connected to the receiving portion 21 and form the pivot centers of the stacker 22. The tray main body portion 31 of the stacker 22 is pivotally mounted to the receiving portion 21 via the arm portions 32 which form the pivot centers. In other words, when the stacker 22 is in the expanded state, the tray main body portion 31 can be located at the position spaced apart from the pivot centers. Accordingly, when the stacker 22 is in the expanded state, the upper portion of the receiving portion 21 can be opened in wide manner, and thus workability is improved when the receiving portion 21 is filled with the paper sheets.

The recording head 101 which performs recording on the paper sheet and the paper feeding cassette 11 which is attachably/detachably mounted to the main body 61 having the recording head 101 are provided in the printer 51, and thus the recorded paper sheet which is discharged from the main body 61 can be supported by the stacker 22 in the expanded state. In this case, it is possible to achieve the same operational effects as those described above.

When the paper feeding cassette 11 is mounted, the paper feeding cassette 11 protrudes from one side surface of the main body 61, which constitutes the periphery of the main body 61. In a part of the paper feeding cassette 11, which protrudes from the one side surface, the opening portion 23 is formed between the receiving portion 21 and stacker 22. In addition, the cover 62 which covers the opening portion 23 can be provided on the main body 61. The opening portion 23 is formed between the receiving portion 21 and the stacker 22, and thus presence or absence of the paper sheets in the paper feeding cassette 11 can be easily confirmed through the opening portion 23. Furthermore, the cover 62 is provided on the opening portion 23, and thus foreign matter can be prevented from entering into the opening portion 23.

The cover 62 is disposed, in the paper-sheet transporting path, between the roller 104 as a discharging roller and the stacker 22 as the medium support tray. When the stacker 22 is in the expanded state, the cover 62 can form the upper surface 81 as the guiding surface for guiding the discharged paper sheet to the stacker 22. The discharged paper sheet is smoothly supported by the stacker 22, because, when the stacker 22 is in the expanded state, the cover 62 functions as the intermediate guiding member and forms the upper surface 81 as the guiding surface for guiding the discharged paper sheet to the stacker 22.

The cover 62 is pivotally mounted, and thus the posture of the cover 62 can be changed in accordance with the posture of the stacker 22. The cover 62 is pivotally mounted and the posture of the cover 62 can be changed in accordance with the posture of the stacker 22, and thus it is possible to more smoothly guide the discharged paper sheet to the stacker 22.

The cover 62 also functions as the intermediate guiding member which forms the guiding surface (the upper surface 81) for guiding the paper sheet to the stacker 22, and thus foreign matter can be prevented from entering into the opening portion 23. In addition, the intermediate guiding member also functions as a cover, and thus it is possible to suppress an increase in costs.

In this embodiment, the paper feeding cassette 11 is attachably/detachably mounted to the printer main body. However, the invention can be applied to a configuration in which the paper feeding cassette 11 is integrally provided in the printer main body, that is, the receiving portion 21 receiving the paper sheets is integrally formed in a printer main body. In this case, the stacker 22 is pivotally mounted, as in the embodiment described above.

Embodiment 2

Hereinafter, Embodiment 2 of the invention will be described with reference to the accompanying drawings.

Figure 10:
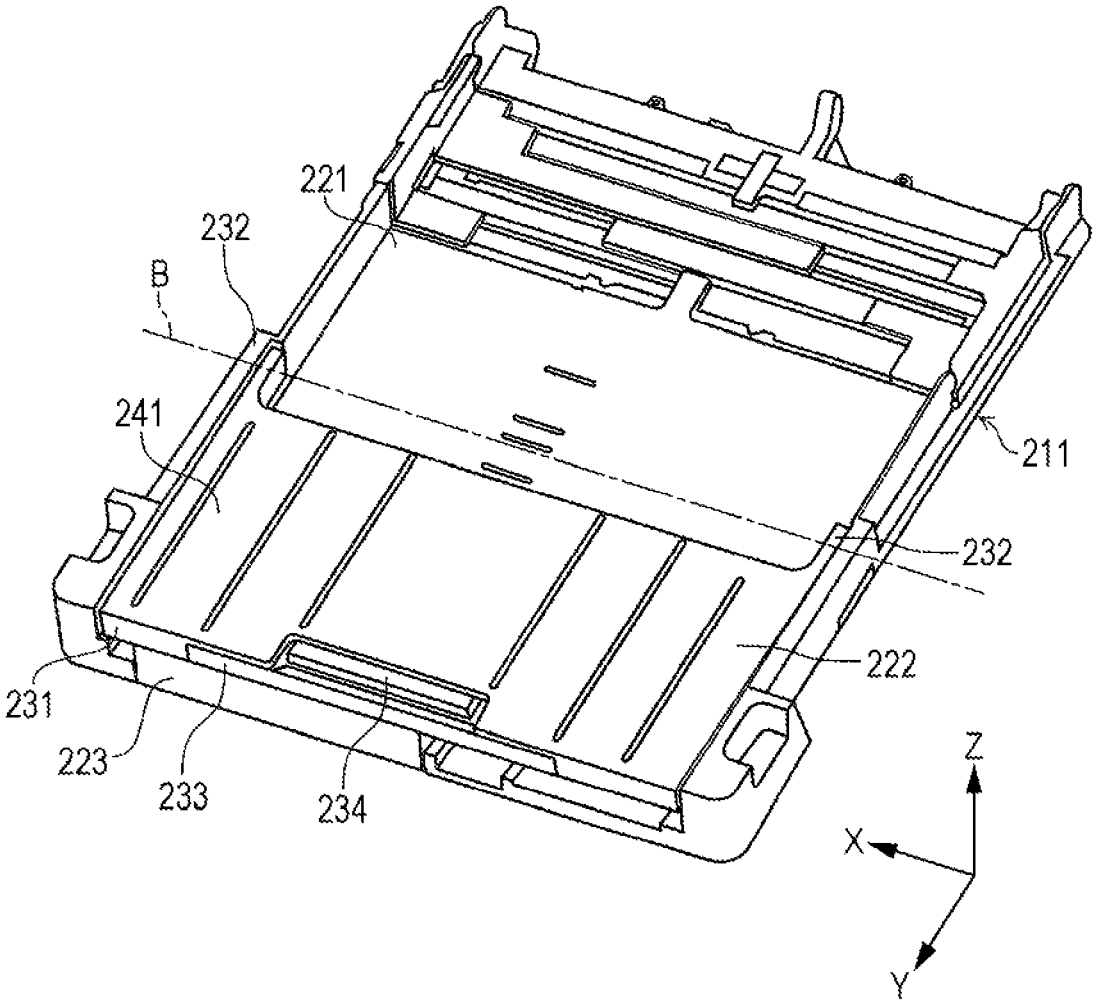
FIG. 10 is a perspective view illustrating an external appearance of a paper feeding cassette according to the invention.
Figure 11:
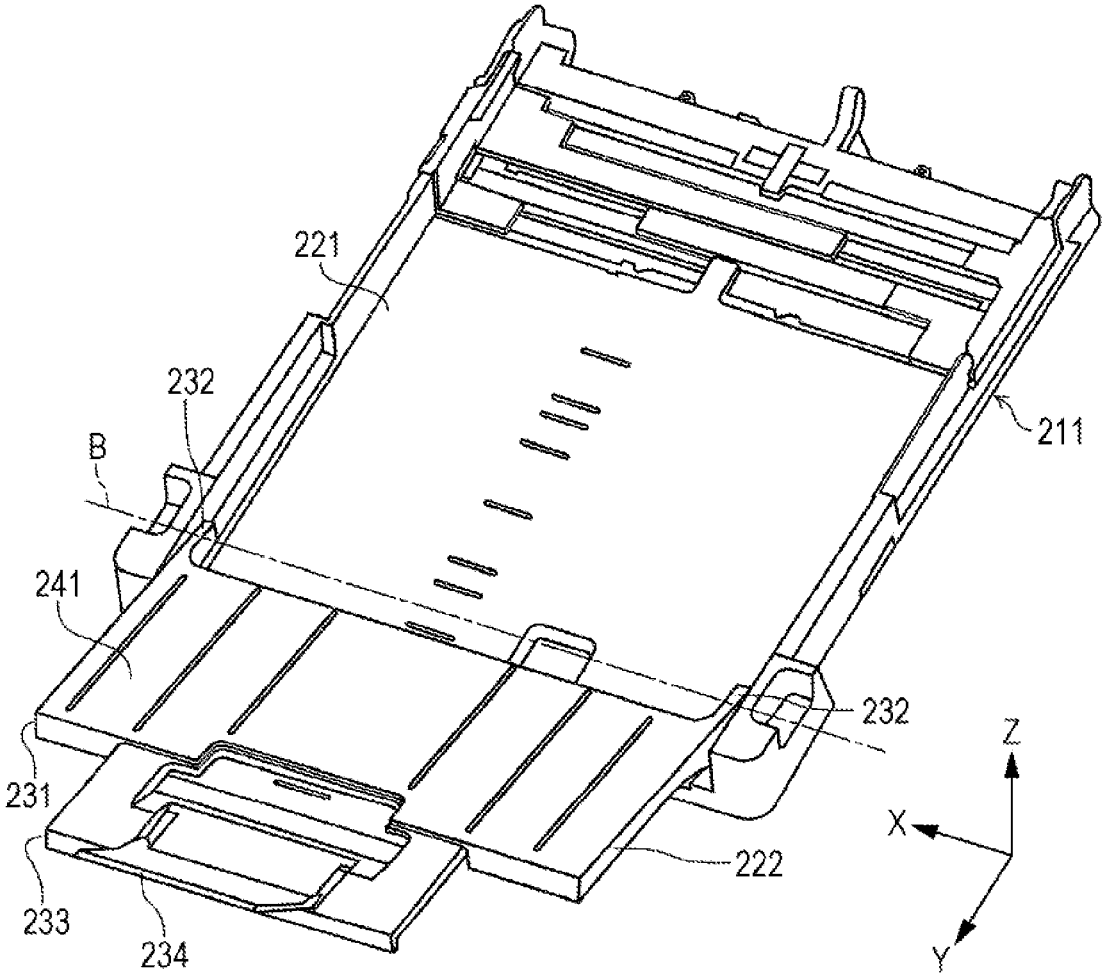
FIG. 11 is a perspective view illustrating an external appearance of the paper feeding cassette according to the invention.

FIGS. 10 and 11 are perspective views illustrating external appearances of a paper feeding cassette 211 according to the Embodiment 2 of the invention. FIG. 10 is a perspective view illustrating the external appearance of the paper feeding cassette 211 in a received state in which a stacker 222 is received in the paper feeding cassette 211. FIG. 11 is a perspective view illustrating the external appearance of the paper feeding cassette 211 in an expanded state in which the stacker 222 is expanded.

In the following description, a front-rear direction of the paper feeding cassette 211 is set to a Y axis, an up-down direction thereof is set to a Z axis, and a right-left direction is set to an X axis. Further, in the following description, a left side in FIG. 10, in terms of an X-axis direction, is simply referred to as a left side and a right side in FIG. 10, in terms of the X-axis direction, is simply referred to as a right side. In addition, in the following description, a front side in FIG. 10, in terms of a Y-axis direction, is simply referred to as a front side and a back side in FIG. 10, in terms of the Y-axis direction, is simply referred to as a rear side. In addition, in the following description, an upper side in FIG. 10, in terms of a Z-axis direction, is simply referred to as an upper side and a lower side in FIG. 10, in terms of the Z-axis direction, is simply referred to as a lower side.

The paper feeding cassette 211 is an example of a medium receiving cassette which is attachably/detachably mounted to a main body of a recording apparatus that performs recording on a medium. Paper sheets as an example of media are received in the paper feeding cassette 211.

The paper feeding cassette 211 includes a receiving portion 221, the stacker 222, and a drawer portion 223. The receiving portion 221 is an example of a medium receiving portion and receives paper sheets which are stacked up in the Z-axis direction. The paper feeding cassette 211 is mounted to a printer 291 (see FIG. 19, described below) as an example of a recording apparatus. When the printer 291 performs printing on the paper sheets, the printer 291 causes the received paper sheet to be fed from the receiving portion 221 and to be transferred. Then the printer 291 performs recording on the paper sheet.

Figure 12:
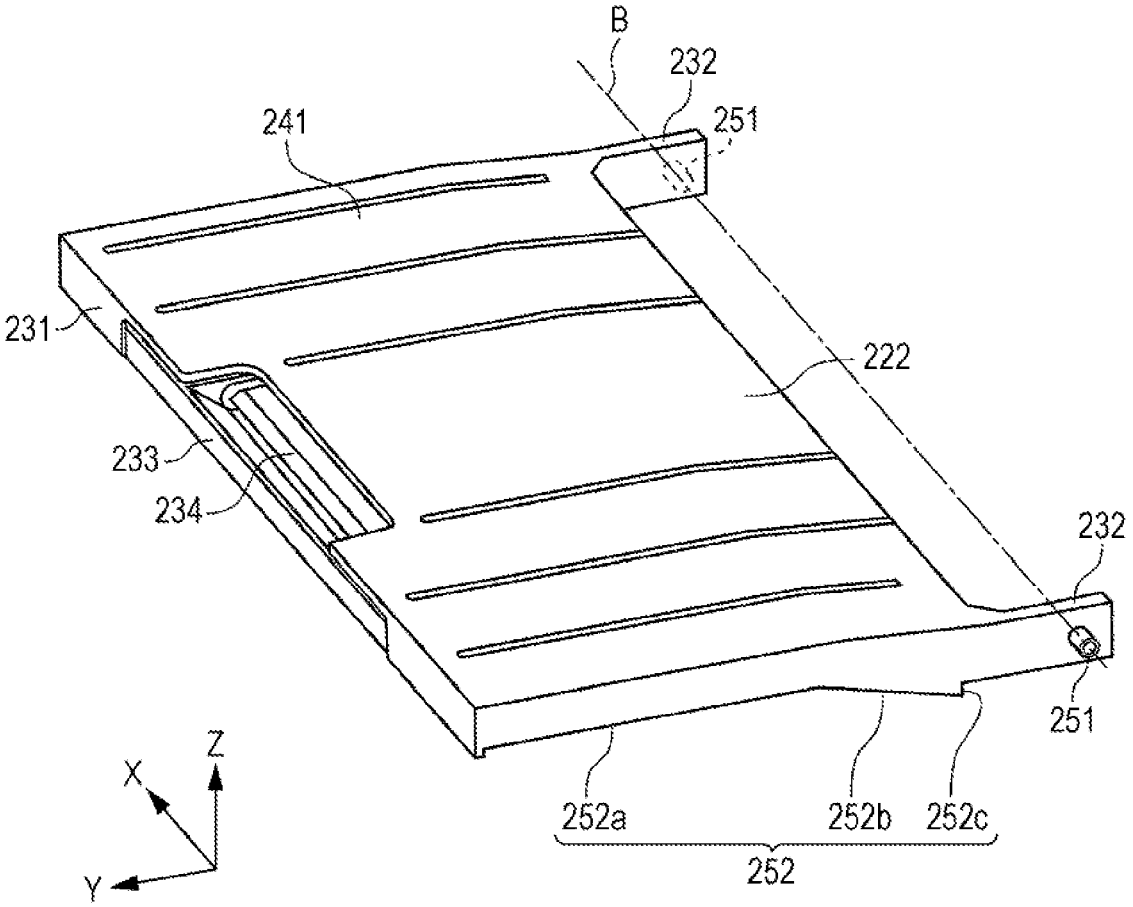
FIG. 12 is an enlarged view illustrating a stacker.

FIG. 12 is an enlarged view illustrating the stacker 222. The stacker 222 is an example of a medium support tray. In a case where the paper feeding cassette 211 is mounted on the printer 291 and the printer 291 performs recording on the paper sheet, the stacker 222 supports the recorded paper sheet. A state of the stacker 222 can be switched between the received state (see FIG. 10) and the expanded state (see FIG. 11). A tray main body portion 231, arm portions 232, a drawer tray 233, and an expansion tray 234 are provided in the stacker 222. The tray main body portion 231 is an example of a tray main body portion. A support surface 241 as an example of a medium support surface is formed on an upper surface of the tray main body portion 231. The support surface 241 supports the paper sheet.

The stacker 222 can move in a front-rear direction, with respect to the receiving portion 221. In other words, the stacker 222 is installed to be displaceable in a sliding manner, with respect to the receiving portion 221. Furthermore, the stacker 222 is mounted to the receiving portion 221 in a state where the stacker 222 can pivot at any position in a range within which the stacker 222 slides. In addition, line B illustrated in FIGS. 10 to 12 shows a pivot axis line which is a pivot center axis of the stacker 222.

When the stacker 222 is in the received state, the stacker 222 is positioned above the receiving portion 221. In this case, the support surface 241 is substantially parallel to a bottom surface of the receiving portion 221. When the stacker 222 is in the expanded state, a position of the support surface 241 in the Z-axis direction gradually moves upward as a position of the support surface 241 in the Y-axis direction gradually moves forward. In other words, when the stacker 222 is in the expanded state, the support surface 241 which supports the paper sheet forms a surface inclined obliquely upward toward a front edge portion. In addition, when the stacker 222 is in the expanded state, the support surface 241 is expanded outside the receiving portion 221. Therefore, the paper sheet which is discharged from an upper side of the stacker 222 and supported by the support surface 241 can be prevented from slipping off the stacker 222. Therefore, the paper sheet can be supported appropriately.

The stacker 222 can take a different posture (that is, the support surface 241 is positioned at different angles) in a sliding manner. Therefore, the support surface 241 in the received state becomes parallel to a bottom surface of the receiving portion 221, and thus a height (a size in a medium stacking direction) of the paper feeding cassette 211 can be suppressed in the received state. Furthermore, appropriate posture of the stacker 222 in the expanded state can be ensured.

The state of the stacker 222 can be switched between the received state and the expanded state by displacing the stacker 222 in a sliding manner. Therefore, it is possible to switch the state of the stacker 222 in a state where the paper feeding cassette 211 is mounted to an apparatus main body of the recording apparatus, that is, without removing the paper feeding cassette 211 from the apparatus main body.

The stacker 222 is provided in a state where the stacker 222 can pivot at any position in the range within which the stacker 222 slides, and thus, the combination of a slide position of the stacker 222 and the posture thereof is improved in the degree of freedom. For example, in a case where the stacker 222 is slid from a received position to an expanded position for filling the receiving portion 221 with the paper sheets, when the stacker 222 is obstructive, the stacker 222 can be retreated upward in a pivoting manner. Therefore, it is possible to receive the paper sheet with favorable workability.

The stacker 222 is pivoted on the arm portions 232 by a user. Furthermore, the user is not limited to an end user but includes all people operating the paper feeding cassette 211, such as a person who assembles the recording apparatus including the paper feeding cassette 211 and a person who performs customer service. The arm portion 232 is an example of an arm portion and pivotally connected to the receiving portion 221 to form a pivot center of the stacker 222. The arm portions 232 are provided on both end portions of the tray main body portion 231 in the pivot-axis direction of the stacker 222. The arm portions 232 extend from the tray main body portion 231 toward the pivot centers of the stacker 222.

Rotation fulcrums 251 which are protrusions having cylindrical-shapes are formed on a left side of the left arm portion 232 and on a right side of the right arm portion 232. In addition, rotation stoppers 252*a* to 252*c* as "portions to be supported" are provided on left and right sides of a lower surface of the tray main body portion 231. A rotation stopper 252 is constituted by a first section 252*a*, a second section 252*b* and a third section 252*c*. The first section 252*a* has a first linear shape which extends, in a direction parallel to the Y axis, from a front surface of the tray main body portion 231 by a predetermined distance. The second section 252*b* has a second linear shape which is formed continuous with the first section and inclined gradually downward as the second section 252*b* comes close to a back side. The third section 252*c* has a third linear shape which is formed continuous with the second section and extends in a direction parallel to the Z axis by a predetermined distance.

Figure 13:
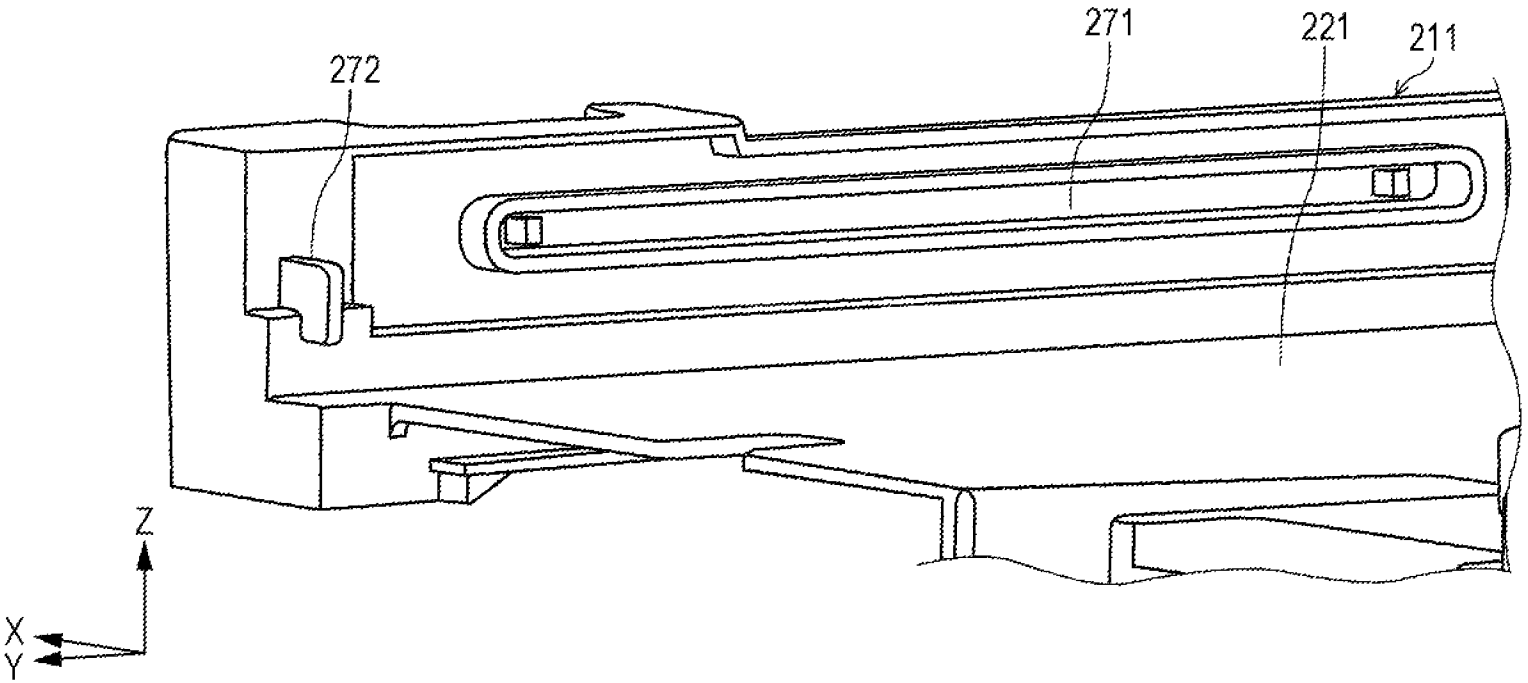
FIG. 13 is a view illustrating an inner shape of a receiving portion.

FIG. 13 is a view illustrating an inner shape of the receiving portion 221. A guide rail 271 and a rotation stopper 272 as an "angle regulation portion" are provided on a part of a side surface inside the receiving portion 221, which is parallel to a surface formed by the Z axis and the Y axis. The guide rail 271 is a concave portion linearly extending in the Y-axis direction. The guide rail 271 forms a concave portion which allows the rotation fulcrum 251 to be rotationally inserted therein. The rotation fulcrum 251 is inserted into the guide rail 271, and thus the arm portion 232 can move in the Y-axis direction, with respect to the receiving portion 221. Furthermore, the arm portion 232 can pivot, with respect to the receiving portion 221, at any position in the range within which the arm portion 232 can move in the Y-axis direction.

The rotation stopper 272 has a protrusion shape extending in the Z-axis direction. The rotation stopper 272 regulates a posture of the stacker 222 by supporting the rotation stopper 252.

As described above, the stacker 222 includes the tray main body portion 231 which forms the support surface 241 and the arm portions 232. In this case, the arm portions 232 are provided on both end portions of the tray main body portion 231 in the pivot-axis direction of the stacker 222 and extend from the tray main body portion 231 toward the pivot centers of the stacker 222. Furthermore, the arm portions 232 are pivotally connected to the receiving portion 221 and form the pivot centers of the stacker 222.

Accordingly, the tray main body portion 231 of the stacker 222 is pivotally mounted to the receiving portion 221 via the arm portions 232 which form the pivot centers. That is, when the stacker 222 is in the expanded state, the tray main body portion 231 can be located at a position spaced apart from the pivot centers. In other words, when the stacker 222 is in the expanded state, the tray main body portion 231 can be located at the position spaced apart from the receiving portion 221. Accordingly, when the stacker 222 is in the expanded state, an upper portion of the receiving portion 221 can be opened in wide manner, and thus workability is improved when the receiving portion 221 is filled with the paper sheets.

The rotation fulcrum 251 and the rotation stopper 252 are provided in the stacker 222. The rotation fulcrum 251 forms the pivot center of the stacker 222 and is guided, in a sliding direction of the stacker 222, by the guide rail 271 which is provided in the receiving portion 221. When the stacker 222 is in the expanded state, the rotation stopper 252 regulates the posture of the stacker 222 in such a manner that the rotation stopper 252 is supported by the rotation stopper 272 formed in the receiving portion 221. Thus, it is possible to cause the stacker 222 to slide and pivot with a simple structure.

The drawer tray 233 can be received in the tray main body portion 231 or can be drawn out from the tray main body portion 231. When the drawer tray 233 is received in the tray main body portion 231, a front edge of the drawer tray 233 is aligned with a front edge (a front edge of an end portion opposite an end portion in which the arm portion 232 is provided) of the tray main body portion 231. In addition, when the stacker 222 is in the expanded state and the drawer tray 233 is drawn out from the tray main body portion 231, an upper surface of the drawer tray 233 and the support surface 241 form a substantially single surface. Thus, the drawer tray 233 practically expands the support surface 241 to a front edge side of the tray main body portion 231.

The expansion tray 234 is pivotally mounted to the front edge of the drawer tray 233. The expansion tray 234 can be received in the drawer tray 233 or can be expanded from the drawer tray 233. When the expansion tray 234 is received in the drawer tray 233, the expansion tray 234 is accommodated in a concave portion which is formed in the drawer tray 233 and of which the shape corresponds to the expansion tray 234. Accordingly, the expansion tray 234 does not obstruct receiving of the drawer tray 233 in the tray main body portion 231 or drawing-out of the drawer tray 233 from the tray main body portion 231.

In a state where the stacker 222 is expanded and the drawer tray 233 is drawn out from the tray main body portion 231, when the expansion tray 234 is expanded from the drawer tray 233, the expansion tray 234 forms a surface which is inclined further upward from the front edge of the drawer tray 233 which forms an surface inclined obliquely upward. In other words, the expansion tray 234 forms a surface inclined obliquely upward at angles greater than the angles of an inclined surface of the drawer tray 233, with respect to the drawer tray 233 which forms a surface inclined obliquely upward at the predetermined angles, relative to a horizontal plane formed by the X axis and the Y axis. As a result, the paper sheet which is discharged from the upper side of the stacker 222 and supported by the support surface 241 is prevented from slipping off from the front edge of the tray main body portion 231. Therefore, the paper sheet can be supported appropriately.

The drawer portion 223 constitutes a front-side (a paper-sheet discharging direction side: +Y side) wall surface of the receiving portion 221. The drawer portion 223 is provided on a front side of the paper feeding cassette 211 and can be drawn forward from the receiving portion 221. When a paper sheet having a length longer than a length (a length in the Y-axis direction) of the paper feeding cassette 211 is received in the paper feeding cassette 211, the drawer portion 223 is drawn forward from the receiving portion 221.

In addition, a length (a length in the X direction) of the drawer portion 223 in the paper sheet width direction is shorter than a length of the receiving portion 221 in the paper sheet width direction. Thus, a space 225 (see FIGS. 19 and 20) through which a user's finger can be inserted into is formed on a lateral side of the drawer portion 223. Therefore, it is possible to place user's finger on the drawer portion 223 regardless of the state of the stacker 222, and thus it is possible to easily slide the drawer portion 223. In addition, even in a case where the paper feeding cassette 211 is mounted to the printer main body, it is possible to easily confirm presence or absence of the paper sheet in the paper feeding cassette or a paper residual quantity in the paper feeding cassette, through the space 225 which is formed on the lateral side of the drawer portion 223.

Furthermore, the drawer portion 223 is disposed (on a left side in the drawing, in this embodiment) at a position shifted from a center of the receiving portion 221 in the paper-sheet width direction. Thus, the space 225 can be formed in wide manner on the lateral side of the drawer portion 223. Accordingly, it is possible to more easily operate the drawer portion 223.

Furthermore, the drawer portion 223 is provided to allow a paper sheet having a larger size to be received in the receiving portion 221, and thus an inner wall of the receiving portion 221 may not be provided. For example, any configuration can be applied as long as it can function as an edge guide for supporting a trailing edge of the paper sheet.

As described above, the receiving portion 221 in which the paper sheets are received and the stacker 222 are provided in the paper feeding cassette 211. In this case, the stacker 222 is provided on the receiving portion 221 to be displaceable in a sliding manner. The state of the stacker 222 can be switched, in the sliding manner, between the received state in which the stacker 222 is positioned above the receiving portion 221 and the expanded state in which the support surface 241 for supporting the paper sheet is inclined obliquely upward toward the front edge portion and the support surface 241 is expanded outside the receiving portion 221. The stacker 222 which is provided in the paper feeding cassette 211 can take a different posture in a sliding manner.

The receiving portion 221 in which the paper sheets are received and the stacker 222 are provided in the paper feeding cassette 211. The stacker 222 can be displaced, in a sliding manner, with respect to the receiving portion 221 and is provided in a state where the stacker 222 can pivot at any position in the range within which the stacker 222 slides. In addition, the stacker 222 has the support surface 241 for supporting the paper sheet. The stacker 222 is provided in a state where the stacker 222 can pivot at any position in the range within which the stacker 222 slides, and thus the combination of a slide position of the stacker 222 and the posture thereof is improved in the degree of freedom.

Figure 14:
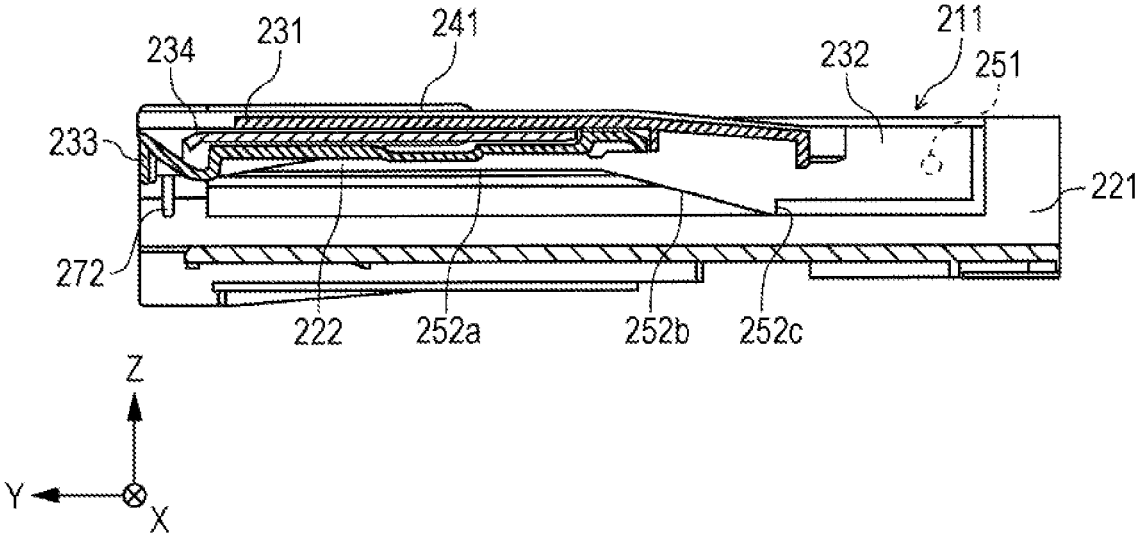
FIG. 14 is an explanatory view illustrating transition of the paper feeding cassette according to the invention from a received state to an expanded state.

Next, transition of the paper feeding cassette 211 from the received state to the expanded state will be described with reference to FIGS. 14 to 18. FIG. 14 is a cross-sectional view illustrating the paper feeding cassette 211 in the received state, taken along a plane parallel to a plane formed by the Z axis and Y axis. When the stacker 222 is in the received state, the stacker 222 is positioned above the receiving portion 221. More specifically, the stacker 222 is disposed above the receiving portion 221 such that a front surface of the tray main body portion 231 of the stacker 222 and a front surface of the paper feeding cassette 211 form a single surface.

When the stacker 222 is in the received state, the expansion tray 234 which is pivotally mounted to a front edge of the drawer tray 233 is received in the drawer tray 233. In addition, when the stacker 222 is in the received state, the drawer tray 233 in a state where the expansion tray 234 is received in the drawer tray 233 is received in the tray main body portion 231.

Figure 15:
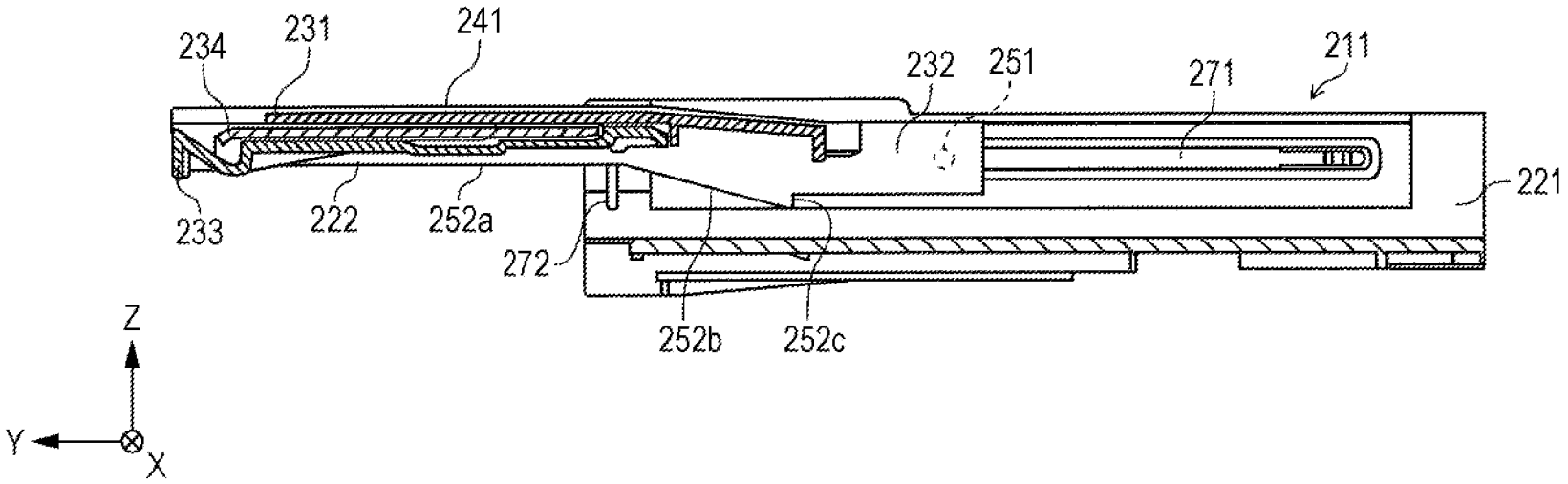
FIG. 15 is an explanatory view illustrating the transition of the paper feeding cassette according to the invention from the received state to the expanded state.

When the stacker 222 is drawn forward from the paper feeding cassette 211 by a user, the rotation fulcrum 251 moves forward along the guide rail 271 and the first section 252*a* (the portion having the first linear shape which extends, in the direction parallel to the Y axis, from a front surface of the tray main body portion 231 by the predetermined distance) of the rotation stopper 252 is supported by the rotation stopper 272, as illustrated in FIG. 15. Thus, the stacker 222 moves forward in a direction substantially parallel to the receiving portion 221.

Figure 16:
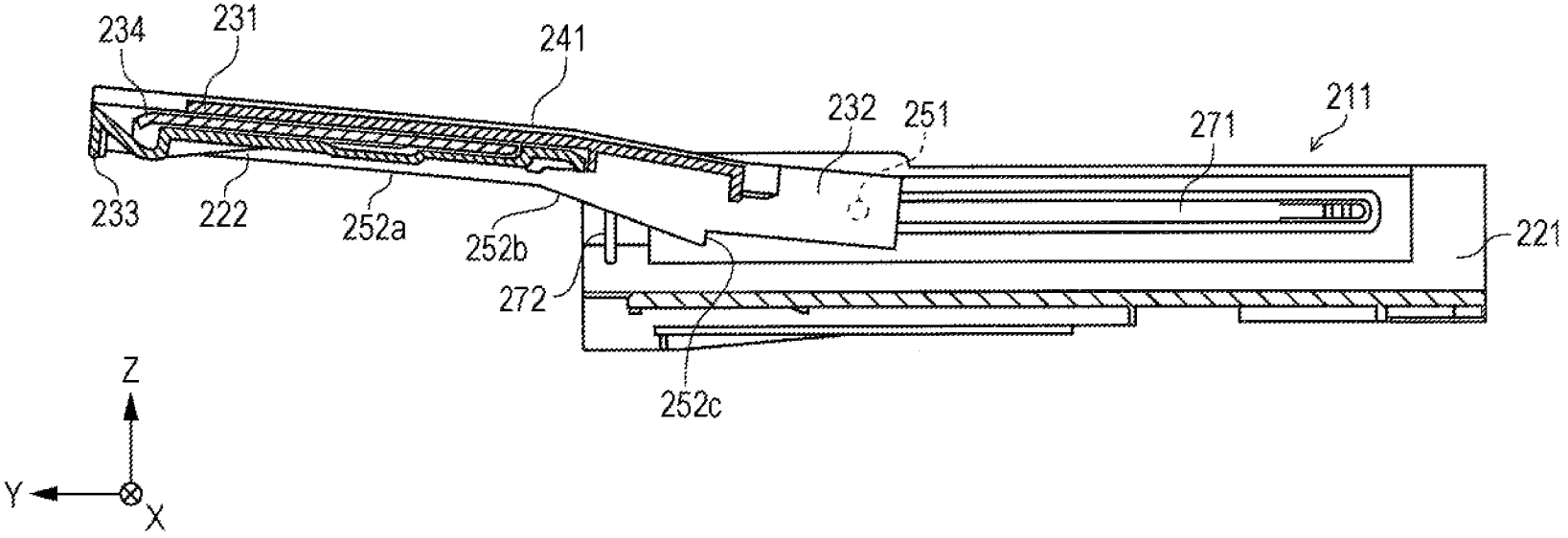
FIG. 16 is an explanatory view illustrating the transition of the paper feeding cassette according to the invention from the received state to the expanded state.

When the stacker 222 is drawn further forward by a user, the rotation stopper 272 comes into contact with the second section 252*b* (the portion having the second linear shape which is formed continuous with the first section 252*a* and inclined gradually downward as the second section 252*b* comes close to the back side) of the rotation stopper 252, as illustrated in FIG. 16. The second section 252*b* of the rotation stopper 252 is inclined gradually downward as the second section 252*b* comes close to the back side and the rotation fulcrum 251 moves forward along the guide rail 271 in a state where a vertical position of the rotation fulcrum 251 is maintained. Therefore, a front side of the stacker 222 is inclined upward, and thus the support surface 241 which supports the paper sheet forms a surface inclined obliquely upward toward the front edge portion.

Figure 17:
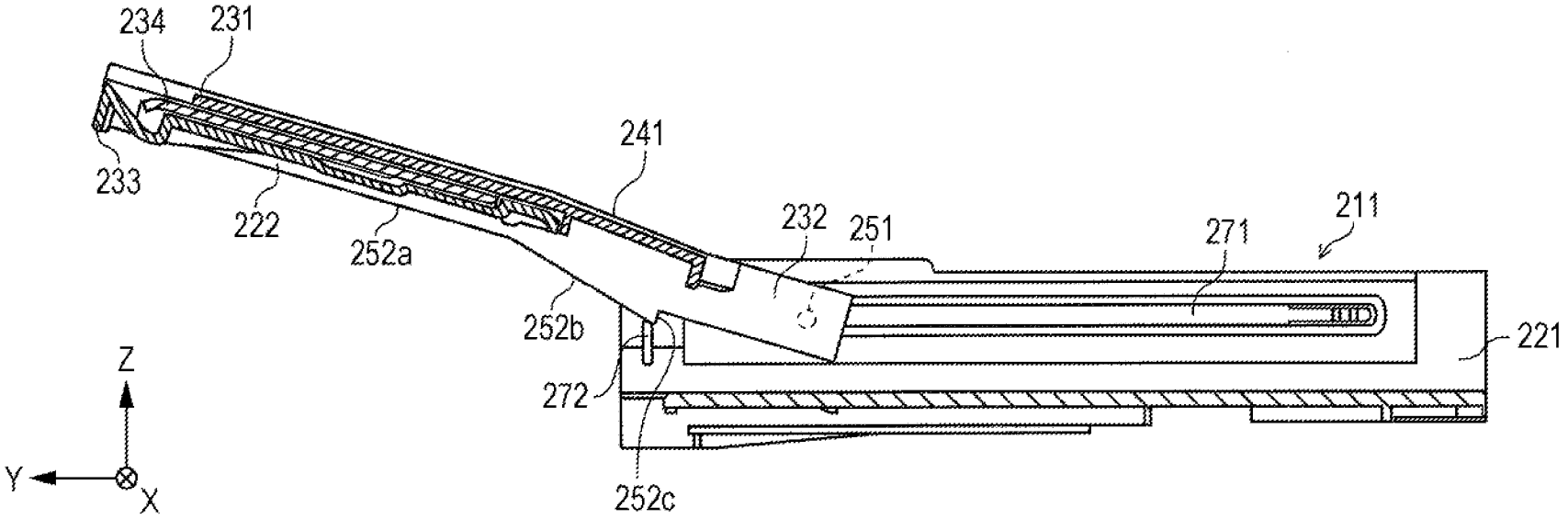
FIG. 17 is an explanatory view illustrating the transition of the paper feeding cassette according to the invention from the received state to the expanded state.

When the stacker 222 is drawn further forward, by a user, from the position illustrated in FIG. 16, a back side position of the second section 252*b* of the rotation stopper 252 is supported by the rotation stopper 272 and the rotation fulcrum 251 moves forward along the guide rail 271 in a state where the vertical position of the rotation fulcrum 251 is maintained, as illustrated in FIG. 17. Thus, the stacker 222 is further inclined.

Figure 18:
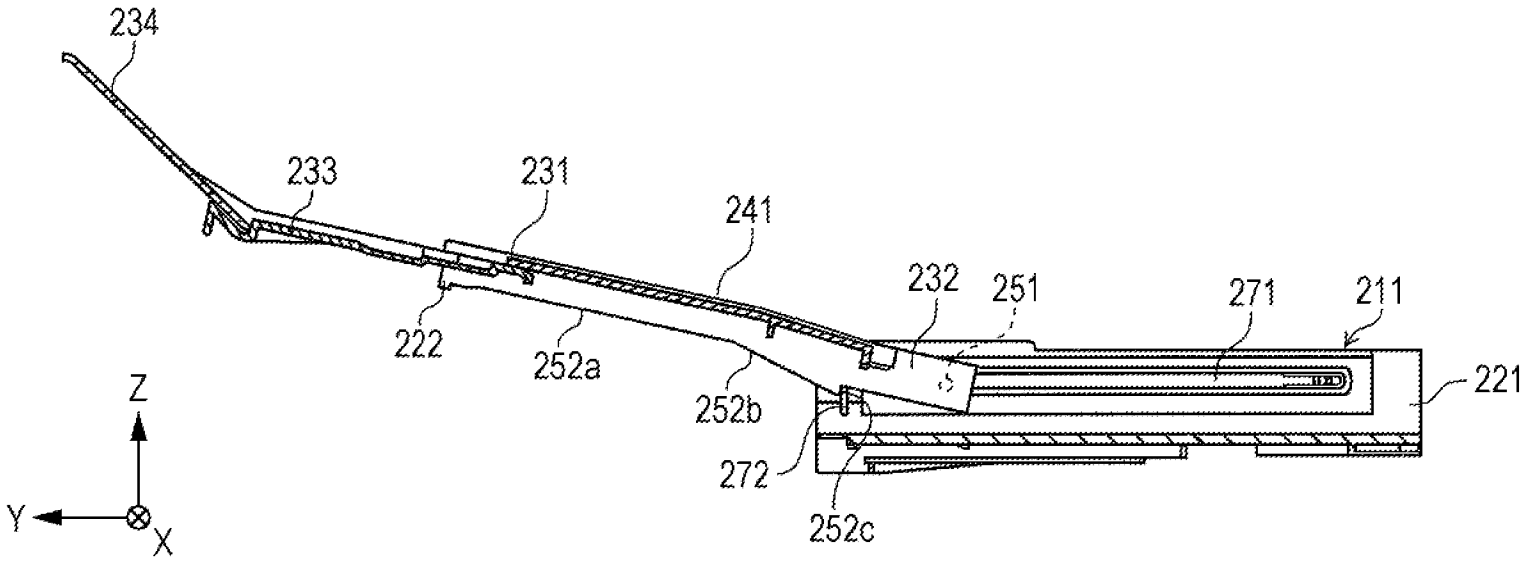
FIG. 18 is an explanatory view illustrating the transition of the paper feeding cassette according to the invention from the received state to the expanded state.

When the stacker 222 is drawn further forward from the position illustrated in FIG. 17 by a user, the rotation stopper 272 is fitted to the third section 252*c* (the portion having the third linear shape which is formed continuous with the second section 252*b* and extends in the direction parallel to the Z axis by the predetermined distance) of the rotation stopper 252, as illustrated in FIG. 18. In addition, the third section 252*c* of the rotation stopper 252 is supported by the rotation stopper 272 and the vertical position of the rotation fulcrum 251 is maintained by the guide rail 271. Furthermore, the rotation fulcrum 251 comes into contact with a front side of the guide rail 271.

Accordingly, the posture of the stacker 222 is stabilized in a state where the front side of the stacker 222 is inclined upward and the support surface 241 forms a surface inclined obliquely upward toward the front edge portion. Then, the drawer tray 233 is drawn out from the tray main body portion 231 by a user. Subsequently, the expansion tray 234 is expanded from the drawer tray 233, in a pivoting manner.

As a result, the paper feeding cassette 211 is in the expanded state, as illustrated in FIG. 18.

Next, a printer to which the paper feeding cassette 211 is mounted will be described.

Figure 19:
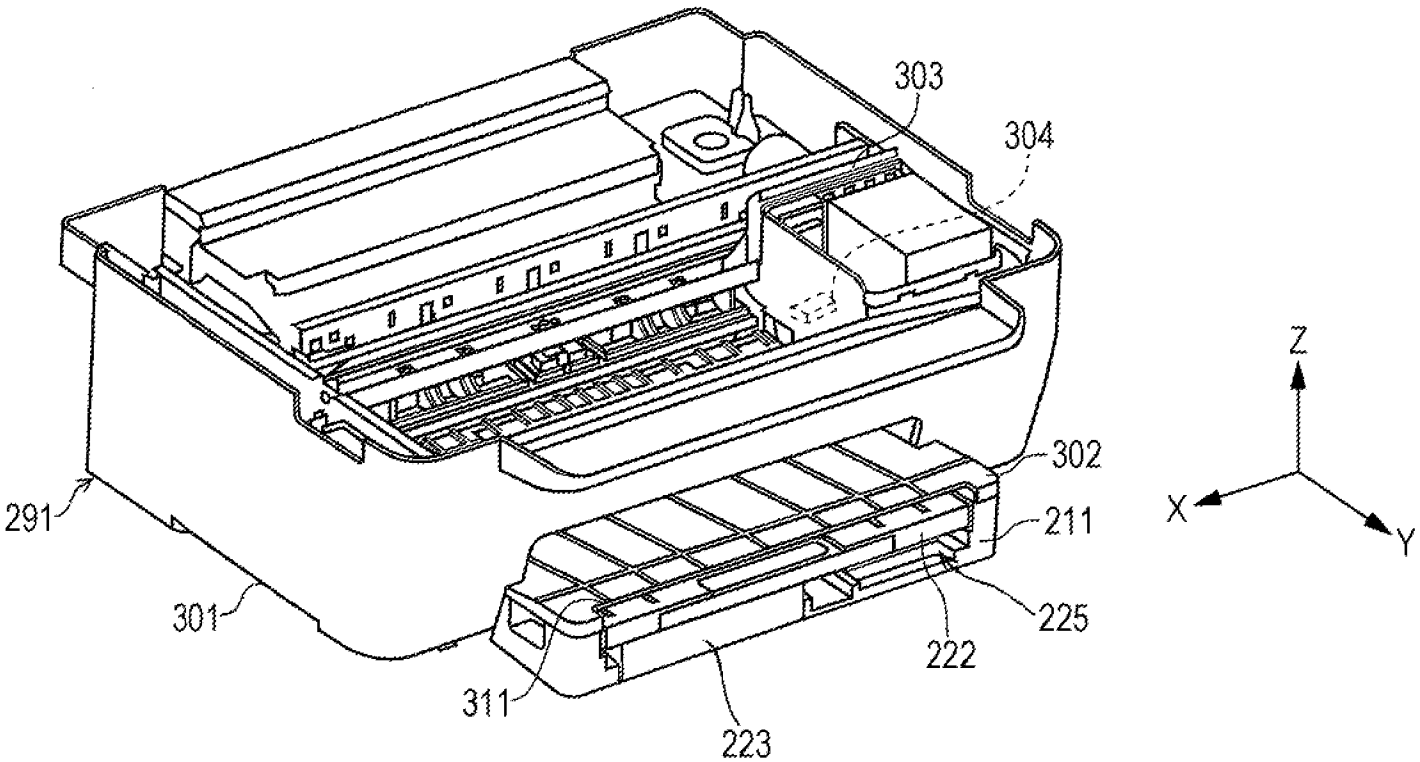
FIG. 19 is a perspective view illustrating a cross-sectional surface and an external appearance of the upper side of the printer according to the invention.
Figure 20:
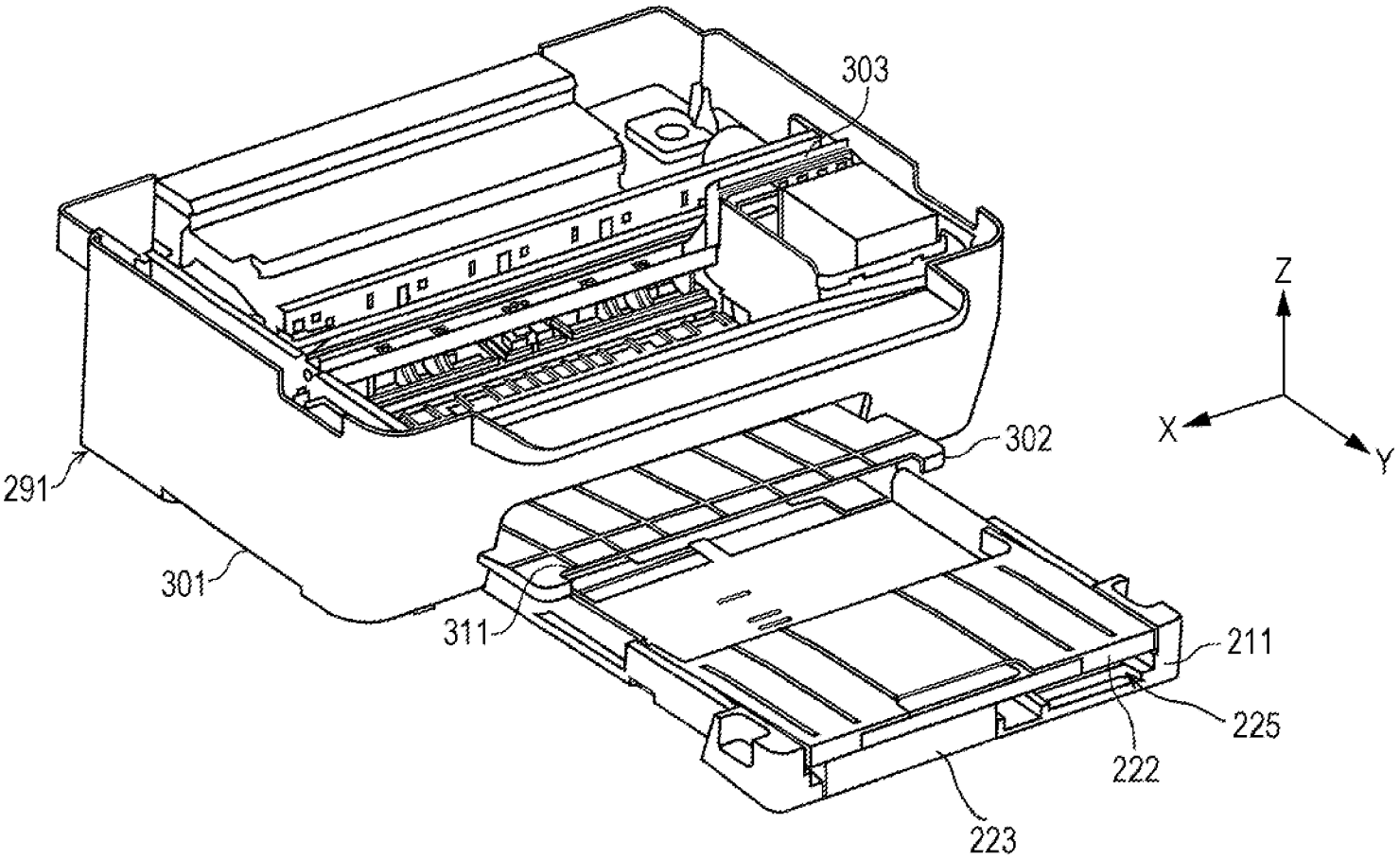
FIG. 20 is a perspective view illustrating a cross-sectional surface and an external appearance of the upper side of the printer according to the invention.
Figure 21:
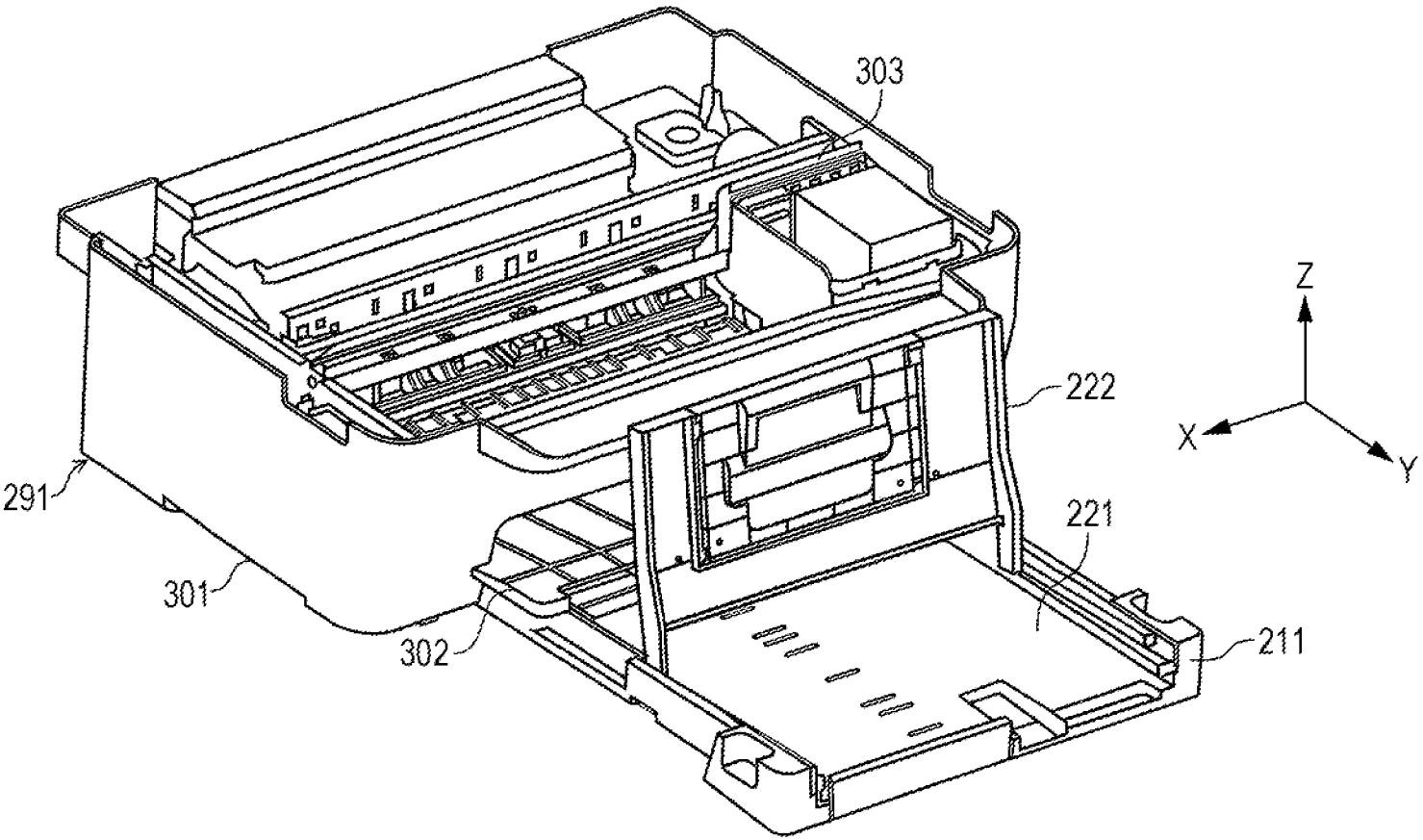
FIG. 21 is a perspective view illustrating a cross-sectional surface and an external appearance of the upper side of the printer according to the invention.
Figure 22:
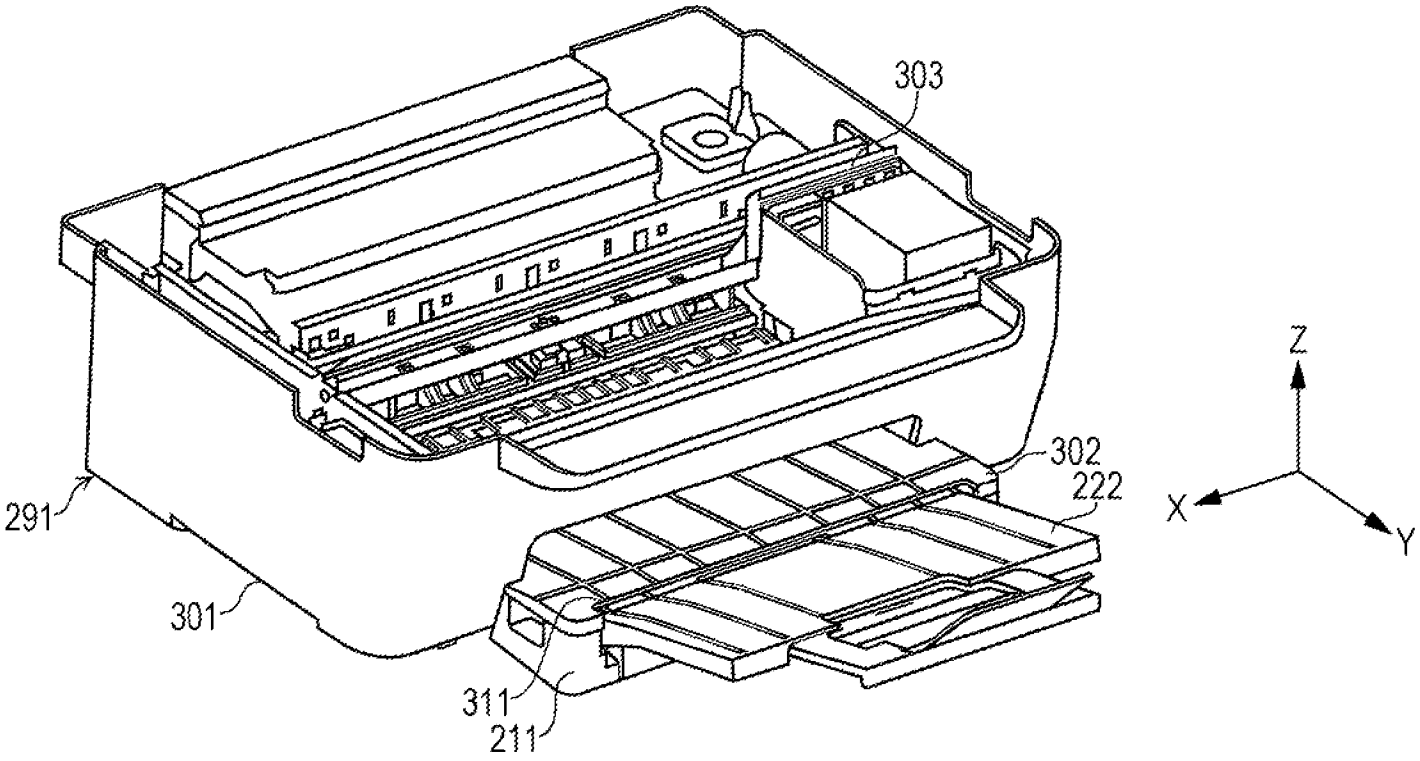
FIG. 22 is a perspective view illustrating a cross-sectional surface and an external appearance of the upper side of the printer according to the invention.

FIGS. 19 to 22 are perspective views illustrating cross-sectional surfaces and external appearances of the upper side of the printer 291 equipped with the paper feeding cassette 211. FIG. 19 is a perspective view illustrating the cross-sectional surface and the external appearance of the upper side of the printer 291 equipped with the paper feeding cassette 211 in the received state. FIG. 20 is a perspective view illustrating the cross-sectional surface and the external appearance of the upper side of the printer 291 in a state where the paper feeding cassette 211 in the received state is drawn out. FIG. 21 is a perspective view illustrating the cross-sectional surface and the external appearance of the upper side of the printer 291 in a state where the stacker 222 of the drawn paper feeding cassette 211 is opened in a pivoting manner. FIG. 22 is a perspective view illustrating the cross-sectional surface and the external appearance of the upper side of the printer 291 in a state where the paper feeding cassette 211 in the expanded state is mounted.

The printer 291 is an example of a recording apparatus and records text, images or the likes on the paper sheet which is received in the paper feeding cassette 211. The paper feeding cassette 211, a main body 301, a cover 302, a carriage 303, and a recording head 304 are provided in the printer 291. A transport portion (not illustrated) which is used for transporting the paper sheet, an operation panel (not illustrated) which is operated by a user, a controller (not illustrated), which controls the entirety of the printer 291, and the like are provided in the main body 301 of the printer 291, in addition to the cover 302, the carriage 303, and the recording head 304.

The main body 301 is an example of an apparatus main body. The cover 302 is an example of a guiding member. The cover 302 is provided on an opening portion which is an opening portion of the main body 301 and to which the paper feeding cassette 211 is mounted. When the paper feeding cassette 211 is mounted to the main body 301, the cover 302 covers an upper portion of a part of the paper feeding cassette 211, which protrudes from a side surface of the main body 301. A notch (an opening) 311 through which a part of the stacker 222 in the received state is exposed is formed on the cover 302. In other words, the notch 311 which is formed in a rectangular shape when viewed from an upper side is formed on a front edge portion of the cover 302, and thus an opening is formed in the front edge portion. Therefore, favorable gripping performance is ensured when the stacker 222 is drawn out, and thus it is possible to easily draw out the stacker 222.

The carriage 303 includes the recording head 304 which prints text or images on the paper sheet using ink or the like. When recording is performed, the carriage 303 moves in the X-axis direction by receiving power from, for example, a motor (not shown). The recording head 304 is an example of a recording unit and performs recording on the paper sheet. More specifically, the recording head 304 is provided on a bottom surface side of the carriage 303, that is, a side of the paper sheet which is transported by the transporting portion. The recording head 304 prints text or images on the paper sheet using ink or the like.

When not using the printer 291, for example, the state of the paper feeding cassette 211 is switched to the received state, and then the paper feeding cassette 211 in the received state is mounted to the printer 291, as illustrated in FIG. 19. When using the printer 291 or filling the paper feeding cassette 211 with the paper sheets, first, the paper feeding cassette 211 in the received state is drawn out from the printer 291, as illustrated in FIG. 20.

When the paper feeding cassette 211 is filled with the paper sheets, the stacker 222 of the drawn paper feeding cassette 211 is opened in a pivoting manner such that the front edge of the stacker 222 is inclined upward, as illustrated in FIG. 21. Therefore, an upper side of the receiving portion 221 is opened in wide manner, and thus it is possible to easily fill the receiving portion 221 with paper sheet from the upper side of the receiving portion 221. Accordingly, workability is improved when the receiving portion 221 is filled with paper sheets.

When using the printer 291, the state of the paper feeding cassette 211 is switched to the expanded state. In other words, when the stacker 222 is drawn forward by a user in a pivoting manner such that the front edge of the stacker 222 is inclined obliquely upward, the front side of the stacker 222 is inclined obliquely upward. Therefore, the support surface 241 which supports the paper sheet forms a surface inclined obliquely upward toward the front edge portion. In this case, the stacker 222 is expanded outside the receiving portion 221. Subsequently, the drawer tray 233 is drawn out from the tray main body portion 231 by a user, and then the expansion tray 234 is expanded, in a pivoting manner, from the drawer tray 233.

When the paper feeding cassette 211 is in a mounted state, the paper feeding cassette 211 protrudes from one side surface of the main body 301, which constitutes a periphery of the main body 301. The cover 302 covers an upper portion of a part of the paper feeding cassette 211, which protrudes from the one side surface. The recorded paper sheet which is discharged from the main body 301 is supported by the stacker 222 in the expanded state. When the stacker 222 is in the expanded state, the cover 302 guides the discharged paper sheet to the stacker 222. The paper sheet can be smoothly discharged from the main body 301 to the stacker 222, through the cover 302.

Figure 23:
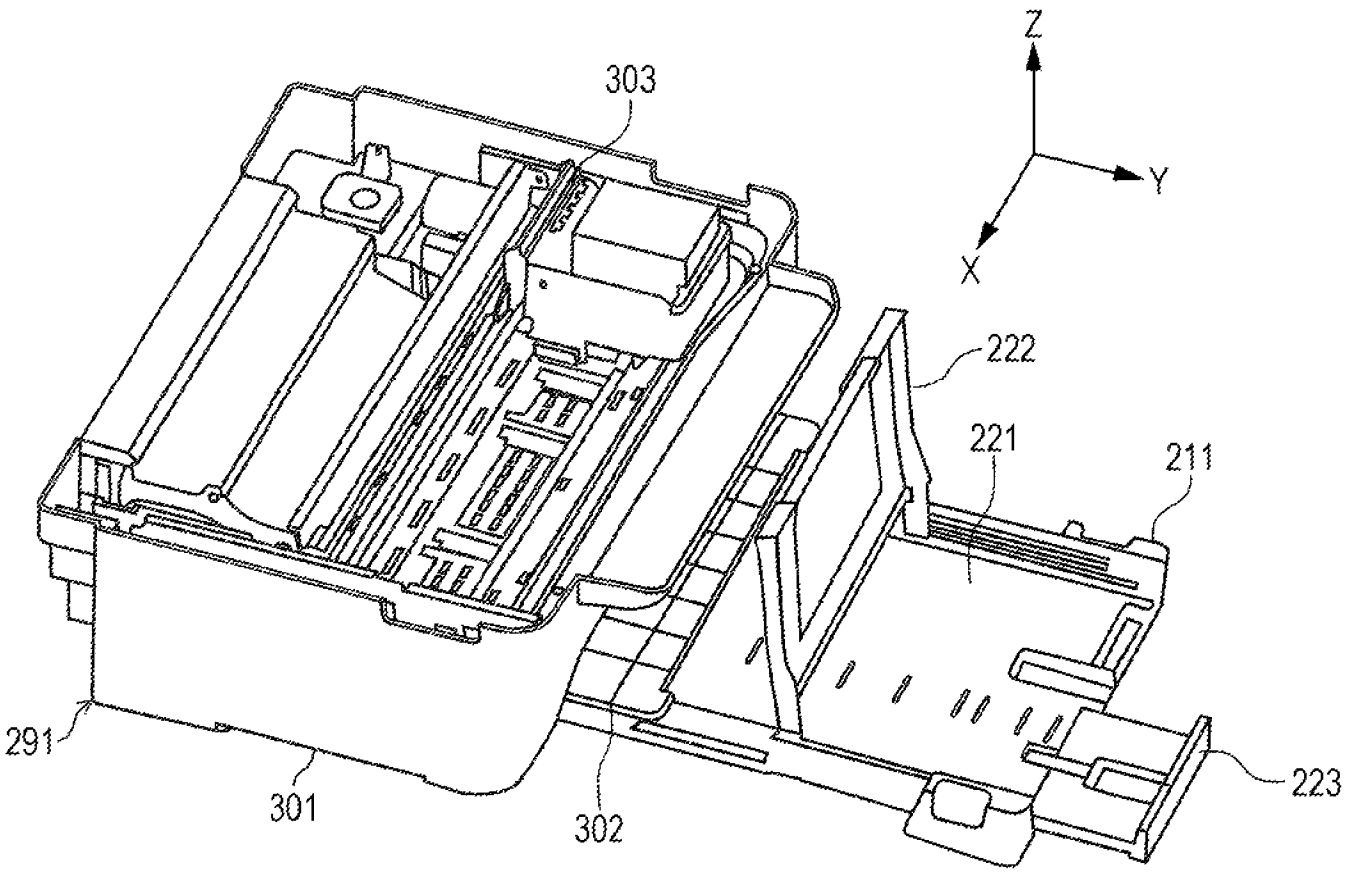
FIG. 23 is a perspective view illustrating a cross-sectional surface and an external appearance of the upper side of the printer according to the invention.

FIG. 23 is a perspective view illustrating a cross-sectional surface and an external appearance of the upper side of the printer 291 in a state where the stacker 222 of the drawn paper feeding cassette 211 is opened in a pivoting manner and the drawer portion 223 is drawn forward from the receiving portion 221. When the drawer portion 223 is drawn forward from the receiving portion 221, the upper portion of the receiving portion 221 is opened in wide manner. Furthermore, the receiving portion 221 is opened in the Y-axis direction in wide manner. Therefore, it is possible to easily fill the receiving portion 221 with the paper sheets. In addition, a paper sheet having a length longer than a length (a length in the Y-axis direction) of the paper feeding cassette 211 can be received in the paper feeding cassette 211.

In addition, it is possible to slide the drawer portion 223 separately from the stacker 222. Thus, when the drawer portion 223 is operated, it is not necessary to operate the stacker 222, and thus operability is improved. In addition, the paper sheets can be set by extending the drawer portion 223, without drawing out the entirety of the paper feeding cassette 211. For this reason, favorable operability is ensured, as well.

Figure 24:
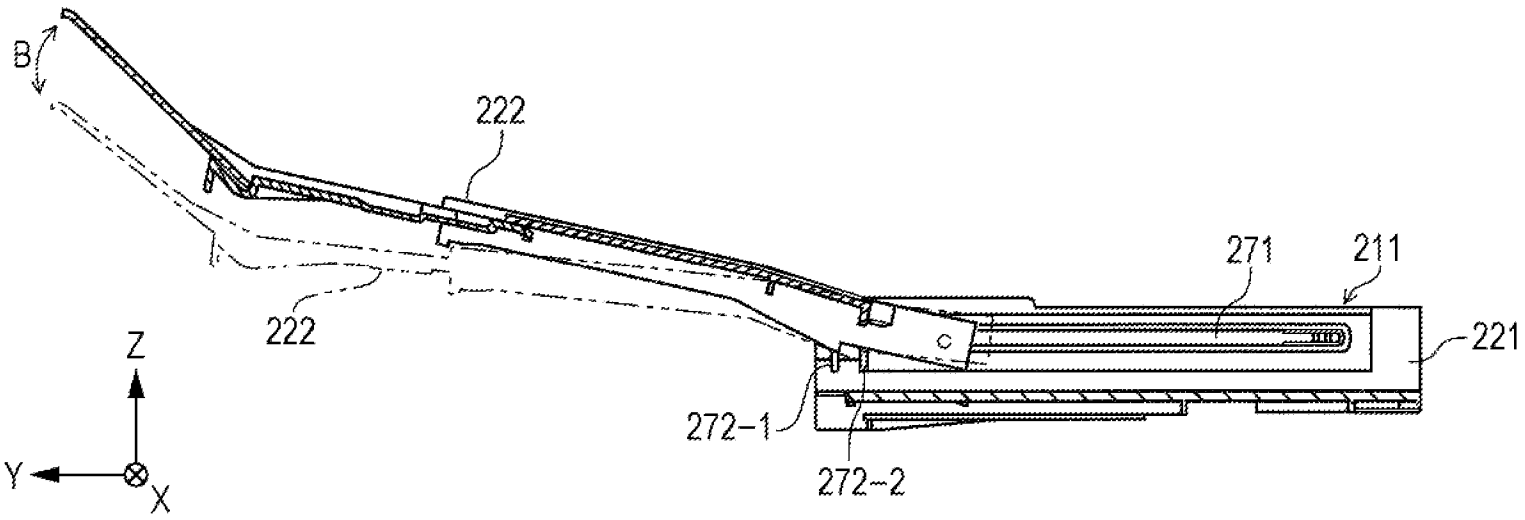
FIG. 24 is a side view illustrating the paper feeding cassette in the expanded state.

In the above description, a configuration in which one rotation stopper 272 is provided is exemplified. However, without being limited thereto, rotation stoppers 272-1 and rotation stoppers 272-2 may be provided in a state where the rotation stoppers 272-1 and the rotation stoppers 272-2 are spaced apart from each other in the Y-axis direction by a predetermined distance, as illustrated in FIG. 24. In this case, a front edge position of the stacker 222 in the expanded state can be changed in the vertical direction by, for example, a distance B illustrated in the accompanying drawings, depending on two cases. One case is that the rotation stoppers 272-1 support the rotation stoppers 252 provided on right and left sides of a lower surface of the tray main body portion 231. The other case is that that the rotation stoppers 272-2 support the rotation stoppers 252.

In other words, inclination angles of the support surface 241 which supports the paper sheet can be changed. As described above, it is possible to switch posture of the stacker 222 by providing a plurality of the rotation stoppers 272 and switching the rotation stoppers 272 engaged with the rotation stopper 252. It is possible to switch posture of the stacker 222 by providing a plurality of the rotation stoppers 272 and switching the rotation stoppers 272 engaged with the rotation stopper 252, and thus the posture of the stacker 222 can be appropriately set in accordance with a type or size of a paper sheet.

The printer 291 is exemplified as an example of a recording apparatus. However, without being limited thereto, the recording apparatus may be a copying machine, a facsimile machine, or other apparatus.

As described above, the receiving portion 221 in which the paper sheets are received and the stacker 222 are provided in the paper feeding cassette 211. The stacker 222 is mounted to the receiving portion 221 in a state where the stacker 222 can be displaced in a sliding manner. The state of the stacker 222 can be switched, in a sliding manner, between the received state in which the stacker 222 is positioned above the receiving portion 221 and the expanded state in which at least a part of the support surface 241 supporting the paper sheet is expanded outside the receiving portion 221. The stacker 222 which is provided in the paper feeding cassette 211 can take a different posture in a sliding manner. Therefore, the height (the size in the medium stacking direction) of the paper feeding cassette 211 can be suppressed in the received state. Thus, appropriate posture of the stacker 222 in the expanded state can be ensured. The state of the stacker 222 can be switched between the received state and the expanded state by displacing the stacker 222 in a sliding manner, and thus it is possible to switch the state of the stacker 222 in a state where the paper feeding cassette 211 is mounted to the apparatus main body of the recording apparatus, that is, without removing the paper feeding cassette 211 from the apparatus main body.

The length of the receiving portion 221 in the paper-sheet discharging direction (the Y direction) can be extended by drawing the drawer portion 223. Thus, it is possible to expand a paper-sheet receiving area in accordance with the size of the paper sheet.

The drawer portion 223 constitutes a wall of the receiving portion 221, which is located on the paper-sheet discharging direction side. In addition, the length of the drawer portion 223 in the paper-sheet width direction (the X direction) which is perpendicular to the paper-sheet discharging direction is shorter than the length of the receiving portion 221 in the paper-sheet width direction. Accordingly, the space 225 is formed on the lateral side of the drawer portion 223. Therefore, it is easy to place user's finger on the drawer portion 223, and thus it is possible to easily draw out the drawer portion 223. In addition, it is possible to easily confirm, through the space 225, presence or absence of the paper sheet in the receiving portion 221 or a paper residual quantity in the receiving portion 221.

The drawer portion 223 is disposed at a position shifted from the center of the receiving portion 221 in the paper-sheet width direction. Thus, the space 225 can be formed in wide manner on the lateral side of the drawer portion 223. Accordingly, it is possible to more easily operate the drawer portion 223.

When the stacker 222 is in the expanded state, the support surface 241 forms the surface inclined obliquely upward toward the front edge portion. Therefore, the discharged paper sheet can be prevented from slipping off the support surface 241, and thus the paper sheet can be appropriately supported.

The stacker 222 is provided in a state where the stacker 222 can pivot at any position in a range within which the stacker 222 slides. Thus, the combination of the slide position of the stacker 222 and the posture thereof is improved in the degree of freedom, because the stacker 222 is provided in a state where the stacker 222 can pivot at any position in a range within which the stacker 222 slides. For example, in a case where the stacker 222 is slid from the received position to the expanded position for filling the receiving portion 221 with the paper sheets, when the stacker 222 is obstructive, the stacker 222 can be retreated upward in a pivoting manner. Therefore, it is possible to receive the paper sheet with favorable workability.

The tray main body portion 231 which forms the support surface 241 and the arm portions 232 are provided in the stacker 222. The arm portions 232 are provided on both end portions of the tray main body portion 231 in the pivot-axis direction of the stacker 222 and extend from the tray main body portion 231 toward the pivot centers of the stacker 222. Furthermore, the arm portions 232 are pivotally connected to the receiving portion 221 and form the pivot centers of the stacker 222. The tray main body portion 231 of the stacker 222 is pivotally mounted to the receiving portion 221 via the arm portions 232 which form the pivot centers. In other words, when the stacker 222 is in the expanded state, the tray main body portion 231 can be located at the position spaced apart from the pivot centers. Accordingly, when the stacker 222 is in the expanded state, the upper portion of the receiving portion 221 can be opened in wide manner, and thus workability is improved when the receiving portion 221 is filled with the paper sheets.

The rotation fulcrum 251 and the rotation stopper 252 are provided in the stacker 222. The rotation fulcrum 251 forms the pivot center of the stacker 222 and is guided, in a sliding direction of the stacker 222, by the guide rail 271 which is provided in the receiving portion 221. When the stacker 222 is in the expanded state, the rotation stopper 252 regulates the posture of the stacker 222 in such a manner that the rotation stopper 252 is supported by the rotation stopper 272 formed in the receiving portion 221. Thus, it is possible to cause the stacker 222 to slide and pivot with a simple structure.

A plurality of the rotation stoppers 272 are provided. Therefore, it is possible to switch the postures of the stacker 222 by switching the rotation stoppers 272 engaged with the rotation stopper 252. It is possible to switch the postures of the stacker 222 by providing a plurality of the rotation stoppers 272 and switching the rotation stoppers 272 engaged with the rotation stopper 252, and thus the posture of the stacker 222 can be appropriately set in accordance with a type or size of a paper sheet.

In addition, the receiving portion 221 in which the paper sheets are received and the stacker 222 are provided in the paper feeding cassette 211. The stacker 222 can be displaced, in a sliding manner, with respect to the receiving portion 221. The stacker 222 is provided in a state where the stacker 222 can pivot at any position in the range within which the stacker 222 slides. Further, the stacker 222 has the support surface 241 which supports the paper sheet. The stacker 222 is provided in a state where the stacker 222 can pivot at any position in the range within which the stacker 222 slides, and thus, the combination of the slide position of the stacker 222 and the posture thereof is improved in the degree of freedom. For example, in a case where the stacker 222 is slid from the received position to the expanded position for filling the receiving portion 221 with the paper sheets, when the stacker 222 is obstructive, the stacker 222 can be retreated upward in a pivoting manner. Therefore, it is possible to receive the paper sheet with favorable workability.

The recording head 304 which performs recording on the paper sheet and the paper feeding cassette 211 which is attachably/detachably mounted to the main body 301 having recording head 304 are provided in the printer 291, and thus the recorded paper sheet which is discharged from the main body 301 can be supported by the stacker 222 in the expanded state.

When the paper feeding cassette 211 is in the mounted state, the paper feeding cassette 211 protrudes from one side surface of the main body 301, which constitutes the periphery of the main body 301. Therefore, it is possible to provide the cover 302 on the main body 301 to cover the upper portion of a part of the paper feeding cassette 211, which protrudes from the one side surface and which functions as the intermediate guiding member which guides the discharged paper sheet to the stacker 222 when the stacker 222 is in the expanded state. Therefore, the paper sheet can be smoothly discharged from the main body 301 to the stacker 222, through the cover 302.

The cover 302 is provided, in the paper sheet transporting path, between a discharging roller (not shown) and the stacker 222 as a medium support tray. The notch (the opening) 311 through which a part of the stacker 222 in the received state is exposed can be formed on the cover 302. An opening is formed on the cover 302 by providing the notch 311 through which a part of the stacker 222 in the received state is exposed. Therefore, favorable gripping performance is ensured when the stacker 222 is drawn out, and thus it is possible to easily draw out the stacker 222.

The invention is not limited to the embodiments described above and can be modified in various ways insofar as it does not depart from the scope of the invention described in the claims. Needless to say, the modification examples are also within the scope of the invention.

The entire disclosure of Japanese Patent Application No. 2013-091043, filed Apr. 24, 2013 is expressly incorporated by reference herein.

What is claimed is:

1. A recording apparatus comprising:

a main body;

a recording unit;

a medium receiving cassette;

a cover pivotally mounted to the main body, an opening portion, wherein the cover covers and opens the opening portion;

wherein the medium receiving cassette is removably mounted in the opening portion when the cover is open, wherein the medium receiving cassette includes:

a medium receiving portion in which a medium that is fed to the recording unit is received, and a medium support tray which supports a medium that is recorded by the recording unit and which is pivotally connected to the medium receiving portion, wherein the medium support tray can be switched, in a pivoting manner, between:

a received state in which the medium support tray is positioned above the medium receiving portion and an expanded state in which at least a part of a medium support surface of the medium support tray is expanded outside the medium receiving portion;

wherein when the medium support tray is in the expanded state, the cover is supported on a portion of the medium support tray and guides the medium that was recorded by the recording unit to be supported on the medium support tray.

2. The recording apparatus according to claim 1, wherein the medium support tray of the medium receiving cassette is switched between:

the received state in which the medium support tray becomes parallel to a bottom surface of the medium receiving portion and the expanded state in which the medium support surface is directed upward.

3. The recording apparatus according to claim 2, further comprising: a drawer portion configured to be drawn out from the medium receiving portion to extend a length of the medium receiving portion in a medium discharging direction.

4. The recording apparatus according to claim 3, wherein the drawer portion constitutes a wall of the medium receiving portion, which is located on a medium discharging direction side, and wherein a length of the drawer portion in a medium width direction which is perpendicular to the medium discharging direction is shorter than a length of the medium receiving portion in the medium width direction.

5. The recording apparatus according to claim 4, wherein the drawer portion is disposed at a position shifted from a center of the medium receiving portion in the medium width direction.

6. A recording apparatus comprising:

a recording unit;

a medium receiving cassette;

a cover mounted to a main body;

an opening portion, wherein the cover is pivotally mounted to the main body, wherein the cover covers and opens the opening portion;

wherein the medium receiving cassette is removably mounted in opening portion and includes:

a medium receiving portion in which a medium that is fed to the recording unit is received, and a medium support tray which is connected to the medium receiving portion and which is displaceable in a sliding manner, wherein a state of the medium support tray can be switched, in a sliding manner, between:

a received state in which the medium support tray is positioned above the medium receiving portion, and an expanded state in which a medium support surface for supporting the medium is expanded outside the medium receiving portion; and wherein when the medium support tray is in the expanded state, the cover is supported on a portion of the medium support tray and guides the medium that was recorded by the recording unit to be supported on the medium support tray.

7. The recording apparatus according to claim 6, wherein the medium support tray of the medium receiving cassette is switched between:

the received state in which the medium support tray becomes parallel to a bottom surface of the medium receiving portion and the expanded state in which a medium support surface of the medium support tray is directed upward.

8. The recording apparatus according to claim 7, further comprising: a drawer portion configured to be drawn out from the medium receiving portion to extend a length of the medium receiving portion in a medium discharging direction.

9. The recording apparatus according to claim 8, wherein the drawer portion constitutes a wall of the medium receiving portion, which is located on a medium discharging direction side, and wherein a length of the drawer portion in a medium width direction which is perpendicular to the medium discharging direction is shorter than a length of the medium receiving portion in the medium width direction.

10. The recording apparatus according to claim 9, wherein the drawer portion is disposed at a position shifted from a center of the medium receiving portion in the medium width direction.

* * * * *